US010564570B2

(12) United States Patent
Kanno

(10) Patent No.: US 10,564,570 B2
(45) Date of Patent: Feb. 18, 2020

(54) IMAGE FORMING APPARATUS ON WHICH TO MOUNT A CONTAINER

(71) Applicant: CANON KABUSHIKI KAISHA, Tokyo (JP)

(72) Inventor: Satoru Kanno, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/247,375

(22) Filed: Jan. 14, 2019

(65) Prior Publication Data

US 2019/0235413 A1 Aug. 1, 2019

(30) Foreign Application Priority Data

Jan. 31, 2018 (JP) ..... 2018-014815

(51) Int. Cl.
*G03G 15/08* (2006.01)

(52) U.S. Cl.
CPC ..... *G03G 15/0863* (2013.01); *G03G 15/0889* (2013.01)

(58) Field of Classification Search
CPC ..... G03G 15/0856; G03G 15/086; G03G 15/0863; G03G 15/0865
USPC ..... 399/12, 27, 258
See application file for complete search history.

(56) References Cited

U.S. PATENT DOCUMENTS 6,415,112 B1 7/2002 Kimizuka
9,910,382 B1 * 3/2018 Barry et al. ..... G03G 15/0865

FOREIGN PATENT DOCUMENTS

JP 2007102024 A 4/2007

* cited by examiner

*Primary Examiner* — William J Royer
(74) *Attorney, Agent, or Firm* — Canon U.S.A., Inc. IP Division

(57) ABSTRACT

An image forming apparatus to form an image includes a mounting portion on which a container containing toner is mounted, a motor to rotate an agitation member in the container, an electrical circuit to acquire an output value corresponding to electrostaticcapacitance between electrodes of the container and a controller. The controller controls the motor to rotate the agitation member, controls the electrical circuit to acquire the output value, and controls to detect the amount of the toner in the container based on the acquired output value. The controller controls to write predetermined information in a memory of the container where the detected amount is below a predetermined amount. Where the predetermined information is stored in the memory of the container currently mounted on the mounting portion, the controller determines whether the container is a refilled container based on the output value acquired while the agitation member is rotating.

17 Claims, 17 Drawing Sheets

CRG-A

CRG-B

IMAGE FORMING APPARATUS ON WHICH TO MOUNT A CONTAINER

BACKGROUND

Field

The present disclosure relates to an image forming apparatus to which a container containing developer is attachable and from which the container is detachable.

Description of the Related Art

An electrophotographic image forming apparatuses forms an image by using toner stored in a container, When an amount of the toner stored in the container is less than a predetermined amount, an output image with less density is formed. Thus, in this case, a user replaces this container mounted on a mounting portion of the image forming apparatus with another container containing toner.

Used containers that have been refilled with toner have commercially been available, and Japanese Patent Application Laid-Open No. 2007-102024 discusses an image forming apparatus that determines whether a container mounted on a mounting portion is a refilled container. In the case of the image forming apparatus discussed in Japanese Patent Application Laid-Open No. 2007-102024, information indicating that the volume of the toner in the container is zero is recorded in a memory arranged on the container. In addition, when a sensor detects that there is toner in the container, the image forming apparatus determines that this mounted container is a refilled container.

In addition, U.S. Pat. No. 6,415,112 discusses an image forming apparatus that detects an amount of toner stored in a container mounted on a mounting portion based on an output voltage that changes with the amount of the toner present between a plurality of electrodes arranged on the container. The image forming apparatus discussed in U.S. Pat. No. 6,415,112 compares the value of the output voltage with a threshold and detects the amount of the toner based on the comparison result.

However, since density of the toner in a container changes depending on environmental conditions (e.g., the temperature and the humidity), the amount of the toner present between the electrodes may change depending on the environmental conditions. Thus, the threshold to be compared with the output voltage value cannot be determined uniquely.

In addition, physical properties of toner with which a used container is refilled may differ from those of the toner manufactured by the maker that manufactures the image forming apparatus. Thus, even when the output voltage value is compared with the threshold, the image forming apparatus may not determine whether the container mounted on the mounting portion is a refilled container.

Thus, even if information indicating that the volume of the toner is zero is recorded in a memory, the image forming apparatus cannot determine whether a refilled container has been mounted on the mounting portion or another container without toner has been mounted on the mounting portion.

SUMMARY

According to an aspect of the present disclosure, an image forming apparatus to form an image by using toner, the image forming apparatus includes a mounting portion on which a container containing the toner is mounted, a motor configured to rotate an agitation member in the container mounted on the mounting portion, an electrical circuit configured to acquire an output value corresponding to electrostatic capacitance between a plurality of electrodes of the container mounted on the mounting portion, and a controller configured to: control the motor to rotate the agitation member of the container mounted on the mounting portion, control the electrical circuit to acquire the output value, detect the amount of the toner in the container mounted on the mounting portion based on the output value acquired by the electrical circuit, and write predetermined information in a memory of the container mounted on the mounting portion in a case where the detected amount is below a predetermined amount, wherein, in a case where the predetermined information is stored in the memory of the container currently mounted on the mounting portion, the controller determines whether the container currently mounted on the mounting portion is a refilled container based on the output value acquired by the electrical circuit while the agitation member is rotating.

Further features of the present disclosure will become apparent from the following description of embodiments with reference to the attached drawings.

DESCRIPTION OF THE EMBODIMENTS

<Electrophotographic Image Forming Apparatus>

Figure 1:
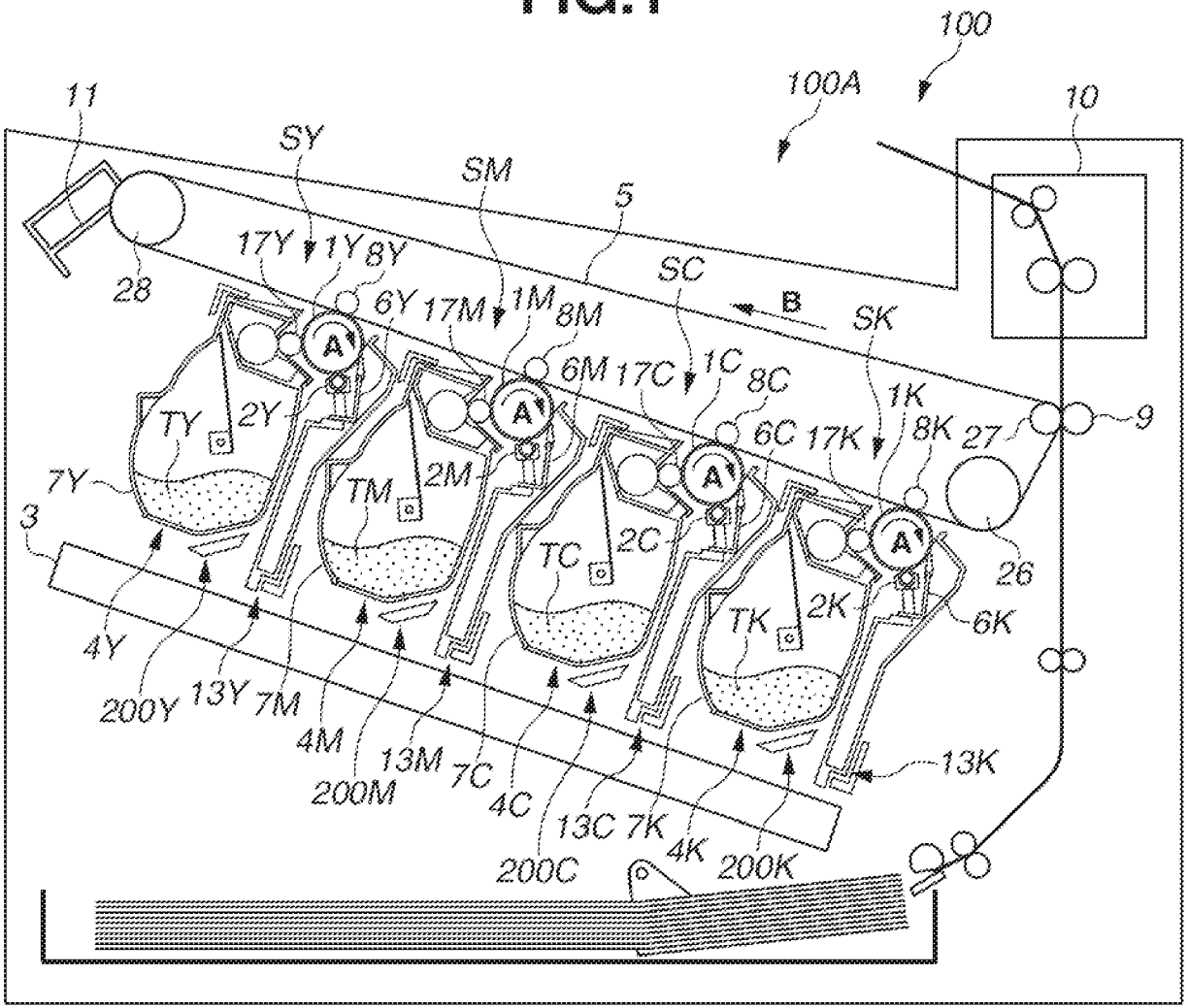
FIG. 1 is a cross-section diagram schematically illustrating an image forming apparatus.
Figure 2:
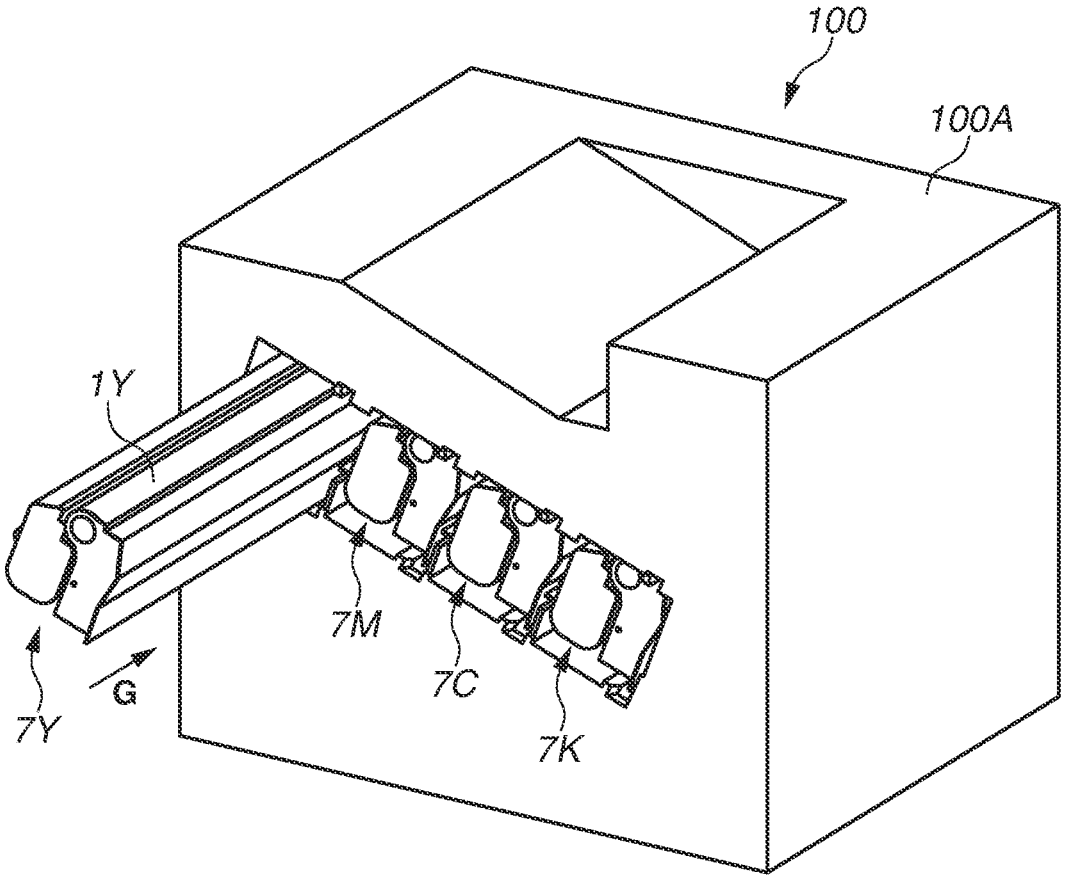
FIG. 2 is a perspective view illustrating process cartridges and the image forming apparatus.

An overall configuration of an electrophotographic image forming apparatus (image forming apparatus) will be described with reference to FIGS. 1 and 2. FIG. 1 is a cross-section diagram schematically illustrating an image forming apparatus 100. FIG. 2 is a perspective view of process cartridges 7 (7Y, 7M, 7C, 7K) mounted on the image forming apparatus 100. The image forming apparatus 100 includes, as a plurality of image forming units, image forming units SY, SM, SC, and SK, which are first to fourth image forming units for forming yellow (Y), magenta (M), cyan (C), and black (K) images, respectively.

In the first embodiment, the first to fourth image forming units have substantially the same configuration and perform substantially the same operation except for colors of the images formed. Thus, unless the image forming units SY to SK need to be distinguished from each other, the image forming units SY to SK will he collectively described by omitting the Y to K included in their respective reference characters. In the first embodiment, the image forming apparatus 100 includes four photosensitive drums 1 (1Y to 1K). Each of the photosensitive drums 1 rotates in a direction of an arrow A in FIG. 1. Charging rollers 2 (2Y to 2K) and a scanner unit 3 are arranged in the vicinity of the photosensitive drums 1.

Each of the photosensitive drums 1 is a photosensitive member formed of an aluminum cylinder, and a photosensitive layer is formed on a surface of the aluminum cylinder. Each of the charging rollers 2 uniformly charges the surface of the corresponding photosensitive drum 1. The scanner unit 3 emits laser light based on image data to form an electrostatic latent image on each of the photosensitive drums 1. In addition, developing units 4 (4Y to 4K) and cleaning blades 6 (6Y to 6K) are arranged in the vicinity of the respective photosensitive drums 1. Each of the developing units 4 includes at least a developing roller 17 (17Y to 17K) that bears developer.

The image forming apparatus 100 also includes a belt-like transfer member 5 that faces the four photosensitive drums 1 and that transfers toner images on the photosensitive drums 1 onto a recording medium (primary transfer process). In addition, in the first embodiment, toner T (TY to TK), which is nonmagnetic mono-component developer, is used in the developing units 4.

The image forming apparatus 100 also includes photosensitive units 13 (13Y to 13K), and each of the photosensitive units 13 includes a removed-toner storage unit 14*a* (see FIG. 3) in which toner that has not been transferred onto the transfer member 5 and that still remains on the corresponding photosensitive drum 1 after the primary transfer process (waste toner) is stored. Each of the photosensitive units 13 also includes the corresponding photosensitive drum 1, the charging roller 2, and the cleaning blade 6. In addition, in the first embodiment, the developing unit 4 and the photosensitive unit 13 are integrated to form the single process cartridge 7 (7Y to 7K). Each of the process cartridges 7 can be mounted on a corresponding mounting portion 200 (200Y to 200K) provided in the image forming apparatus 100. The mounting portion 200 includes a guide (not illustrated) and a positioning member (not illustrated). Each of the process cartridges 7 is attachable to and detachable from the image forming apparatus 100 via the corresponding mounting portion 200. In addition, each of the process cartridges 7 includes at least a photosensitive drum 1 that bears a toner image.

Each of the process cartridges 7 can be mounted on the image forming apparatus 100 in a direction of an arrow G in FIG. 2, which corresponds to an axis direction of the photosensitive drum 1. All the process cartridges 7 for the respective colors have the same shape. However, alternatively, each of the process cartridges 7 may have a different shape and size. For example, the process cartridge 7K may have a larger size to contain more toner than the other process cartridges. The toner T (TY to TK) of yellow (TY), magenta (TM), cyan (TC), and black (TK) is stored in the respective process cartridges 7. The transfer member 5 is in contact with all the photosensitive drums 1 and. moves in a direction of an arrow B in FIG. 1. The transfer member 5 is stretched around a drive roller 26, a secondary transfer counter roller 27, and a driven roller 28.

On an inner circumferential surface of the transfer member 5, four primary transfer rollers 8 (8Y to 8K) are arranged side by side to face the respective photosensitive drums 1. On an outer circumferential surface of the transfer member 5, a secondary transfer roller 9 is arranged at a position to face the secondary transfer counter roller 27.

<Image Forming Process>

When the image forming apparatus 100 forms an image, first, the charging rollers 2 uniformly charge the surfaces of the respective photosensitive drums 1. Next, the scanner unit 3 emits laser light to scan and expose the surfaces of the photosensitive drums 1 therewith. Consequently, an electrostatic latent image based on image data is formed on each of the photosensitive drums I. The electrostatic latent images formed on the photosensitive drums 1 are developed by the respective developing units 4 as toner images. The toner images formed on the photosensitive drums 1 are primarily transferred onto the transfer member 5 by the respective primary transfer rollers 8.

For example, when the image forming apparatus 100 forms a full-color image, the image forming units SY to SK, which are the first to fourth image forming units, sequentially perform the above process to sequentially superimpose the toner images of respective colors onto the transfer member 5. Then, the recording medium is conveyed to a secondary transfer unit in synchronization with movement of the transfer member 5. Then, the toner images of four colors on the transfer member 5 are secondarily transferred onto the recording medium at once by the secondary transfer roller 9, which is in contact with the transfer member 5 via the recording medium.

Then, the recording medium, on which the toner images have been transferred, is conveyed to a fixing unit 10 in which the recording medium is heated and pressurized, Consequently, the toner images are fixed on the recording medium. The toner that remains on the photosensitive drums 1 after the primary transfer process is removed by the respective cleaning blades 6. In addition, the toner that remains on the transfer member 5 after the secondary transfer process is removed by a belt cleaning unit 11. The removed toner (waste toner) is discharged to a waste toner box (not illustrated) of the image forming apparatus 100.

<Process Cartridge>

Figure 3:
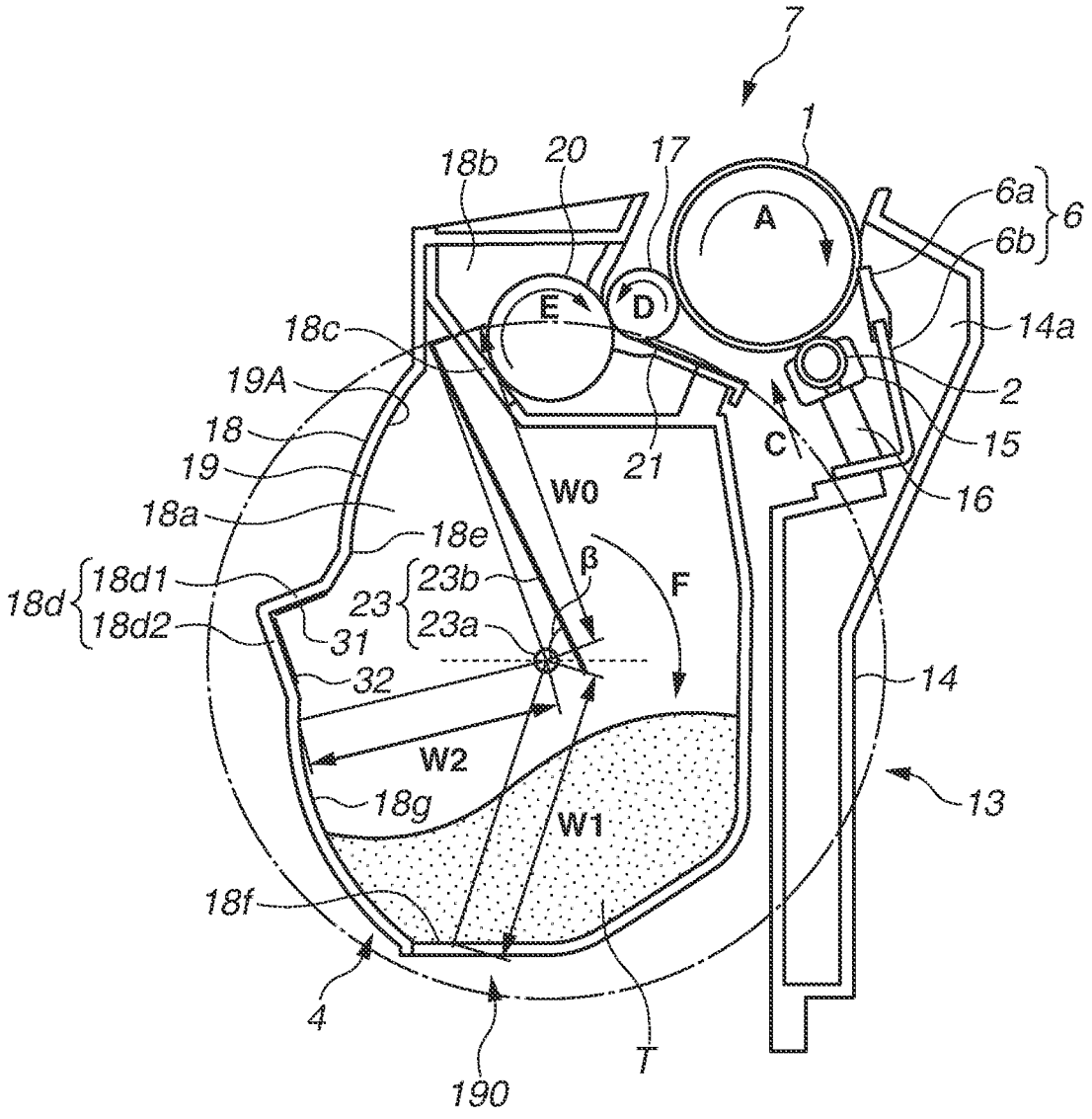
FIG. 3 is a cross-section diagram schematically illustrating a process cartridge.

An overall configuration of the process cartridges 7 mounted on the image forming apparatus 100 will be described with reference to FIG. 3. FIG. 3 is a cross-section diagram schematically illustrating one of the process cartridges 7. The developing unit 4 includes a developing frame 18 that supports various members in the developing unit 4. A developer container 190 includes a container main body 19 that contains toner T, an agitation member 23, a first electrode 31, and a second electrode 32. The process cartridge 7 serves as a container that contains the toner. The developing unit 4 is provided with the corresponding developing roller 17 that supplies the toner to the corresponding photosensitive drum 1. The developing roller 17 bears the toner and rotates in a direction of an arrow D (counterclockwise) in FIG. 3. The developing roller 17 is rotatably supported by the developing frame 18 at two ends of the developing roller 17 in a lengthwise direction (rotational axis direction) thereof via a bearing. The first electrode 31 is arranged, in a recessed portion 18*d*, downstream of the second electrode 32 in a direction of the rotation of the agitation member 23 (direction of an arrow F). The second electrode 32 is arranged, in the recessed portion 18*d*, upstream of the first electrode 31 in the direction of the rotation of the agitation member 23 (direction of the arrow F). The developer container 190 may be configured to be attachable to and detachable from the developing unit 4.

The recessed portion 18*d* has a groove shape that extends in the lengthwise direction of the developing roller 17. The first and second electrodes 31 and 32 also extend in the lengthwise direction of the developing roller 17. A sheet member, which will be described below, also extends in the lengthwise direction. The length of the recessed portion 18*d* in the lengthwise direction of the developing roller 17 is longer than the lengths of the first electrode 31, the second electrode 32, and the sheet member. A leading end of the sheet member can enter the recessed portion 18*d*.

The developing unit 4 includes a toner storage chamber 18*a*, which is a space in the corresponding container main body 19, and a developing chamber 18*b* in which the developing roller 17 is arranged. In addition, an opening 18*c* through which the toner storage chamber 18*a* and the developing chamber 18*b* are communicated is formed in the developing unit 4. The toner storage chamber 18*a* is located below the developing chamber 18*b*. The developing chamber 18*b* includes a toner supplying roller 20, which serves as a developer supply member that is in contact with the developing roller 17 and that rotates in a direction of an arrow E, and a developer regulating member 21, which regulates thickness of a toner layer formed on the developing roller 17.

The toner storage chamber 18*a* of the developer container 190 includes the agitation member 23, which agitates the stored toner T and conveys the toner to the toner supplying roller 20 via the opening 18*c*. The agitation member 23 includes a rotation shaft 23*a* parallel to the rotational axis direction of the developing roller 17, and a flexible agitation sheet 23*b*. Since a leading end of the agitation sheet 23*b* is attached to the rotation shaft 23*a*, the agitation sheet 23*b* rotates as the rotation shaft 23*a* rotates. In this way, the toner is agitated. While rotating, the agitation member 23 slides on an area including at least a bottom portion 18*f* of an inner surface 19A of the container main body 19.

When the agitation member 23 agitates the toner, since the agitation sheet 23*b* comes in contact with the inner surface 19A of the container main body 19, the agitation sheet 23*b* is bent while rotating. However, the agitation sheet 23*b* is released from this bent state at a release position 18*e* on the inner surface 19A of the container main body 19. The agitation sheet 23*b* is released from the bent state when traveling past the release position 18*e*, and then, the toner on the sheet member jumps up by a restoring force due to the release from the bent state. This toner is conveyed to the toner supplying roller 20 in the developing chamber 18*b* and to the developing roller 17 via the opening 18*c*.

Figure 4A:
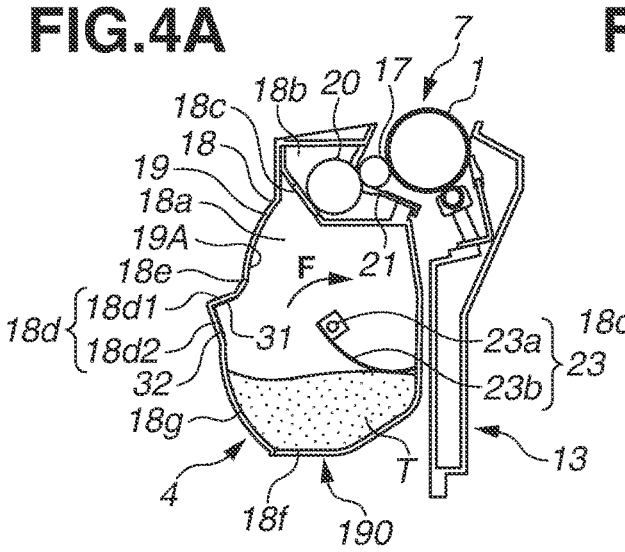
FIGS. 4A to 4E are diagrams schematically illustrating states of developer being agitated.
Figure 4B:
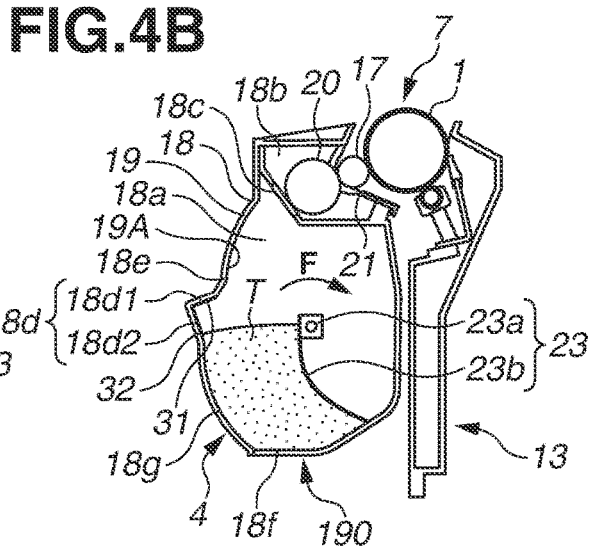
Figure 4C:
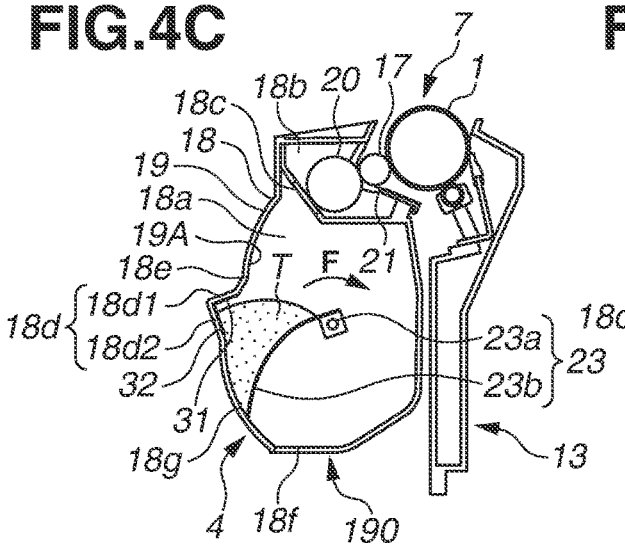

A distance W0 from the rotation shaft 23*a* to the leading end of the agitation sheet 23*b* is set to be longer than a distance W1 from the rotation shaft 23*a* to the bottom portion 18*f* of the container main body 19 so that the toner on the bottom portion 18*f* of the container main body 19 can be agitated and conveyed. Then, states of the agitation sheet 23*b* and the toner during one rotation of the agitation member 23 will be descried with reference to FIGS. 4A to 4E. FIG. 4A illustrates the state of the toner when the agitation sheet 23*b* starts to push a toner surface of the toner on the bottom portion 18*f*. Then, as illustrated in FIGS. 4B and 4C, the agitation sheet 23*b* rotates in a direction of an arrow F and lifts the toner upwards.

Figure 4D:
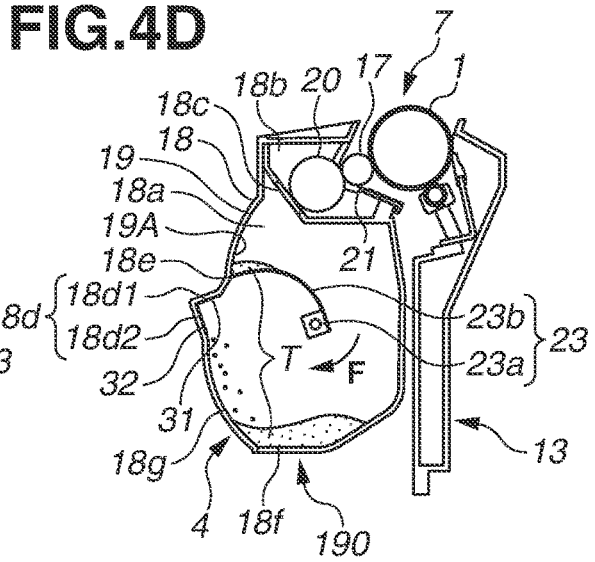
Figure 4E:
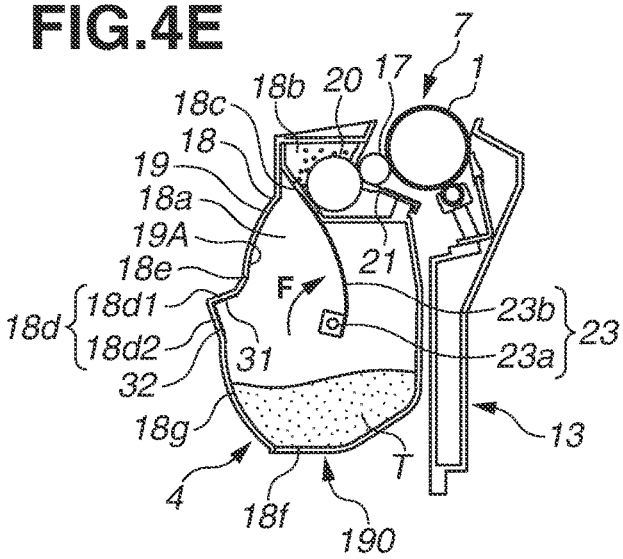

When the agitation sheet 23*b* further rotates in the direction of the arrow F, as illustrated in FIG. 4D, the leading end of the agitation sheet 23*b* comes in contact with the release position 18*e*. In this state, some of the toner still remains on the agitation sheet 23*b*. However, when the leading end of the agitation sheet 23*b* travels past the release position 18*e*, the agitation sheet 23*b* returns to its original state from the bent state. The toner on the agitation sheet 23*b* jumps up toward the opening 18*c* by the restoring force and is supplied to the toner supplying roller 20 via the opening 18*c*. When the agitation sheet 23*b* further rotates, as illustrated in FIG. 4E, the agitation sheet 23*b* collides with the opening 18*c*, and the toner is pushed into the developing chamber 18*b* by the agitation sheet 23*b*. Then, the agitation sheet 23*b* further rotates in the direction of the arrow F, and the agitation sheet 23*b* and the toner return to their states in FIG. 4A, again. Subsequently, the agitation sheet 23*b* continues to rotate in the direction of the arrow F. Each time the leading end of the agitation sheet 23*b* travels past the release position 18*e*, the toner on the agitation sheet 23*b* jumps up and is conveyed to the developing chamber 18*b* via the opening 18*c*.

As illustrated in FIG. 3, the photosensitive unit 13 includes a frame member 14 that supports various parts in the photosensitive unit 13. The corresponding photosensitive drum 1 is attached to the frame member 14 via a bearing member in such a manner that the photosensitive drum 1 can rotate in the direction of the arrow A in FIG. 1. In addition, a charging roller bearing 15 is attached to the frame member 14, and the corresponding charging roller 2 is attached to the charging roller bearing 15 in such a manner that a rotational axis of the charging roller 2 and that of the photosensitive drum 1 are parallel to each other. The charging roller bearing 15 is attached to the frame member 14 in such a manner that the charging roller bearing 15 can move in a direction of an arrow C in FIG. 3. The charging roller 2 is rotatably attached to the charging roller bearing 15, and the charging roller bearing 15 is biased toward the photosensitive drum 1 by a spring 16.

The cleaning blade 6 is formed of an elastic member 6*a* for removing the toner that remains on the surface of the photosensitive drum I after the primary transfer (waste toner), and a supporting member 6*b* for supporting the elastic member 6*a*, The toner removed from surface of the photosensitive drum 1 by the cleaning blade 6 is stored in the corresponding removed-toner storage unit 14*a* formed by the cleaning blade 6 and the frame member 14.

<Configuration of Toner Retraining Amount Detection>

Figure 5:
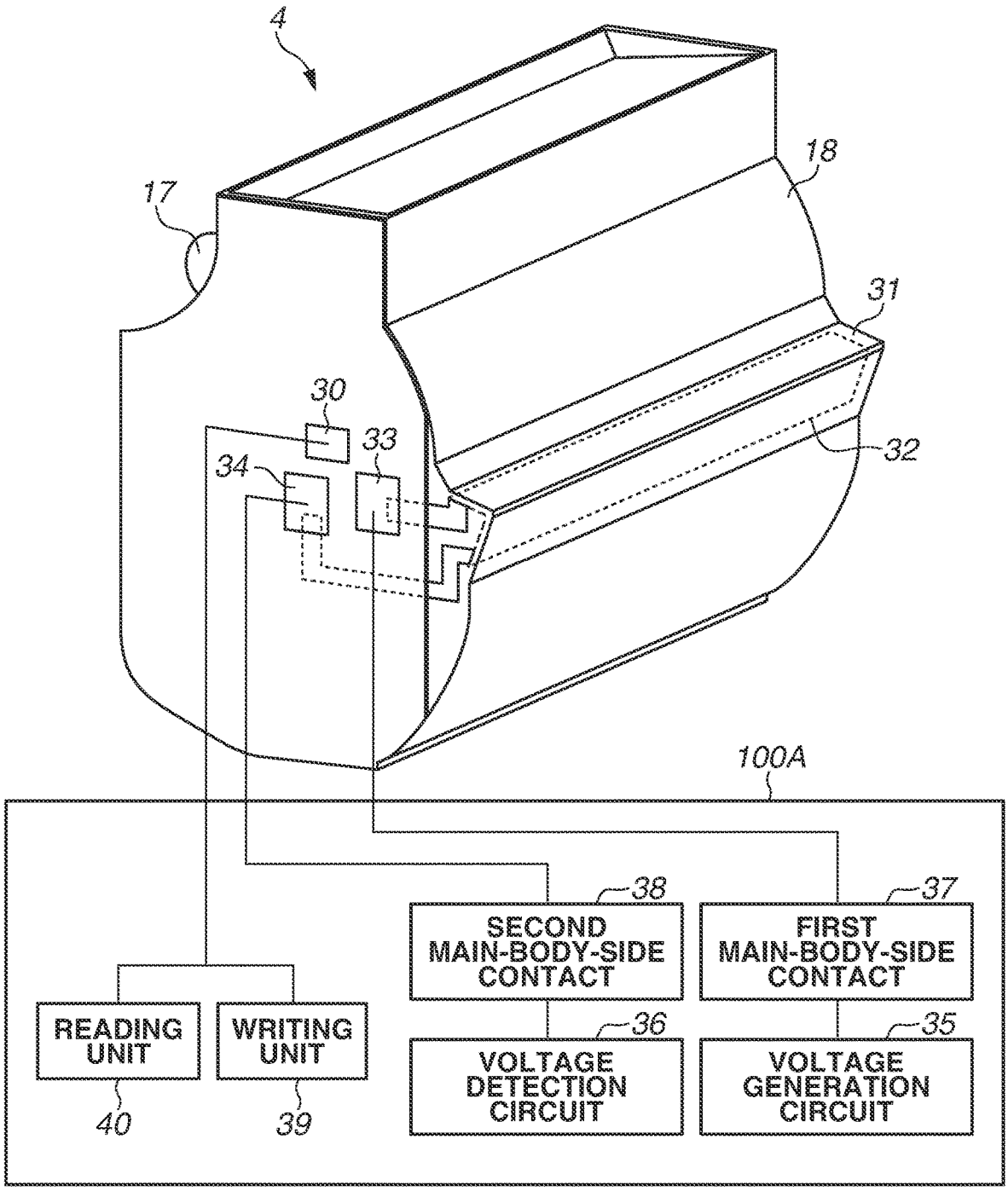
FIG. 5 is a perspective view illustrating a developer container.
Figure 6:
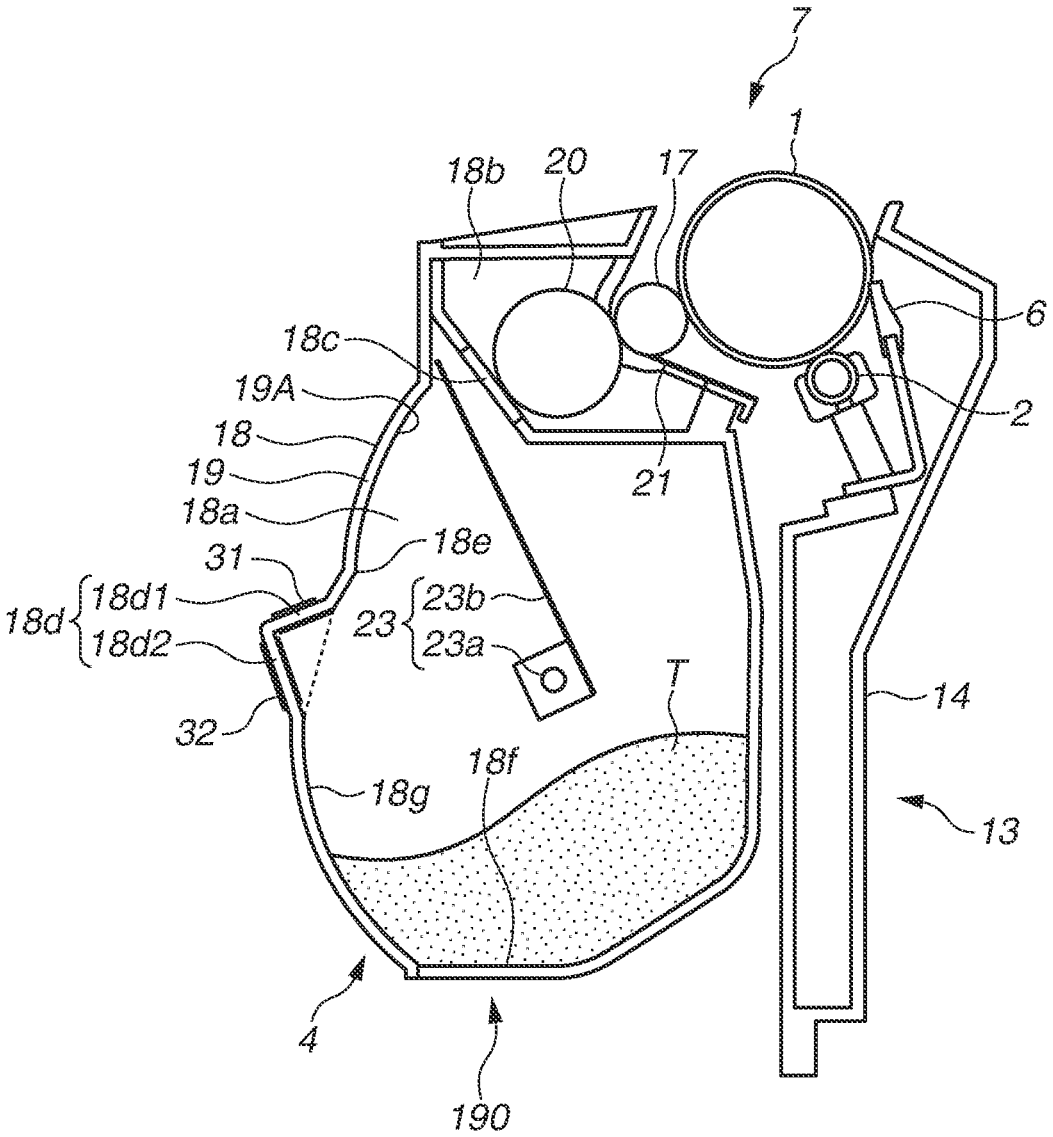
FIG. 6 is a cross-section diagram schematically illustrating a process cartridge.
Figure 7:
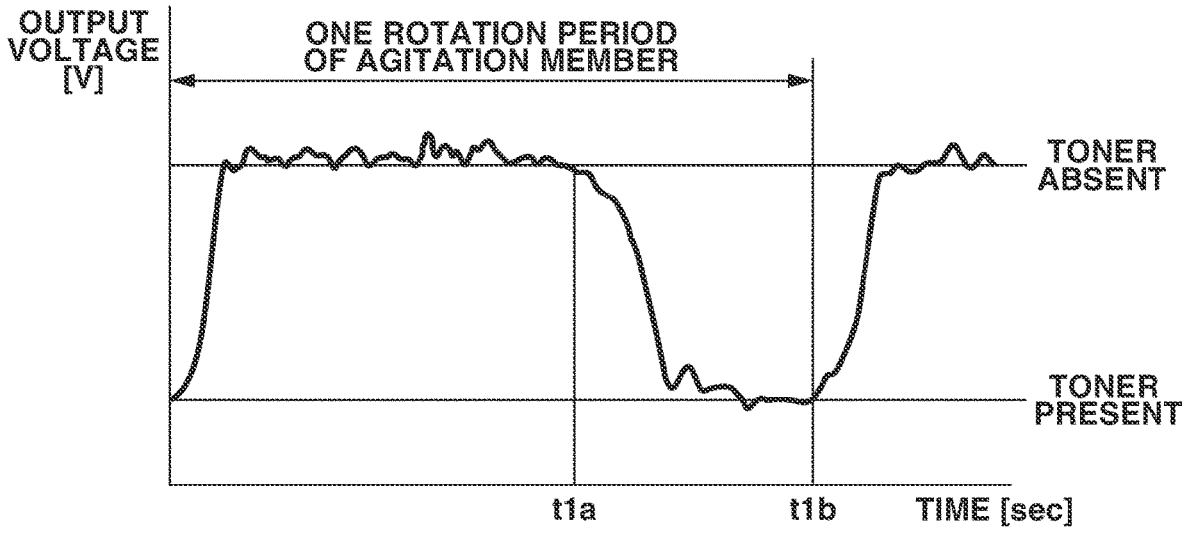
FIG. 7 is a graph schematically illustrating an output voltage obtained during an agitation operation.
Figure 8:
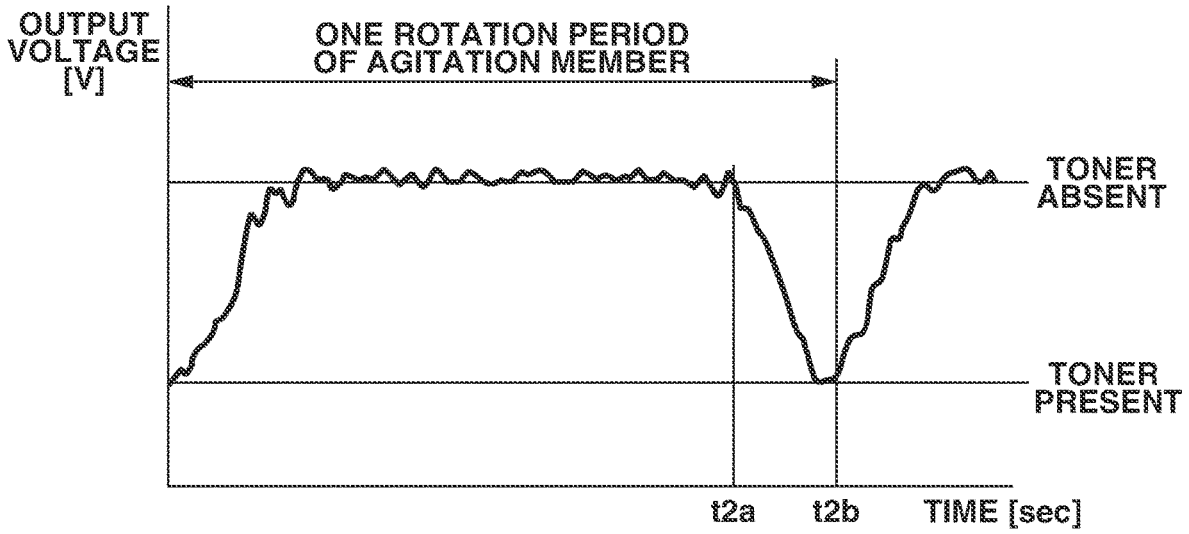
FIG. 8 is a graph schematically illustrating an output voltage obtained during an agitation operation.

A configuration for detecting the amount of the toner in the toner storage chamber 18*a* (toner remaining amount) will be described with reference to FIGS. 3 to 10B. FIGS. 3, 4A to 4E, 6, 9A and 9B, and 10A and 10B schematically illustrate the process cartridge 7. FIG. 5 is a perspective view of the developing unit 4. FIGS. 7 and 8 each illustrate a waveform of an output value that changes with electrostatic capacitance (signal based on electrostatic capacitance). The output value that changes with the electrostatic capacitance is, for example, an output voltage value. In the first embodiment, the toner remaining amount is detected by measuring the electrostatic capacitance between the first and second electrodes 31 and 32.

Any electrode may be used as the above electrodes 31 and 32 as long as the electrode can detect the electrostatic capacitance. For example, a metal plate such as SUS or a conductive resin may be used, In the present embodiment, conductive resin sheets obtained by dispersing carbon black, which is a conductive material, in resin are used.

<Configuration of Recessed Portion in Toner Storage Chamber>

As illustrated in FIG. 3, the recessed portion 18*d* is formed on the inner surface 19A of the container main body 19. Wall surfaces 18*d*1 and 18*d*2 form the recessed portion 18*d*, and the first and second electrodes 31 and 32 are arranged on the wall surfaces 18*d*1 and 18*d*2, respectively. The wall surface 18*d*1 of the recessed portion 18 is the wall located downstream in the rotation direction of the agitation member 23, and the wall surface 18*d*2 of the recessed portion 18 is the wall located upstream in the rotation direction of the agitation member 23. The first and second electrodes 31 and 32 form an angle with respect to the horizontal plane so that the toner on the first and second electrodes 31 and 32 falls by its own weight. More specifically, if the toner enters the recessed portion 18*d*, the toner that has entered the recessed portion 18*d* is discharged from the recessed portion 18*d* by its own weight. In addition, at least a part of the recessed portion 18*d* is located within a rotation radius of the agitation member 23. The length of the recessed portion 18*d* in the lengthwise direction (direction of the arrow G) of the developing unit 4 is longer than the length of the agitation sheet 23*b* in the direction of the arrow G. In addition, when viewed in the lengthwise direction (direction of the arrow G) of the developing unit 4, the recessed portion 18*d* has a triangular shape.

The recessed portion 18*d* is formed at a position where the toner does not enter while the toner is not agitated by the agitation member 23. More specifically, in the toner storage chamber 18*a*, the recessed portion 18*d* is located upstream of the opening 18*c* and the release position 18*e*, and is located downstream of the bottom portion 18*f* of the toner storage chamber 18*a* in the rotation direction of the of the agitation member 23. The recessed portion 18*d* is formed to be located vertically below the release position 18*e* and vertically above the bottom portion 18*f* in a state where the process cartridge 7 is mounted on the corresponding mounting portion 200.

In the present embodiment, while the toner is not agitated in the container main body 19, since the toner that has previously entered the recessed portion 18*d* is already discharged by its own weight from the recessed portion 18*d*, the toner no longer remains in the recessed portion 18*d*. The recessed portion 18*d* is formed at a position where the agitation sheet 23*b* passes after the agitation sheet 23*b* travels past the bottom portion 18*f* and before an angle β of the agitation sheet 23*b* reaches an angle at which the toner on the agitation sheet 23*b* falls off the agitation sheet 23*b*.

As illustrated in FIG. 3, a conveyance regulating surface 18*g* is formed on the inner surface 19A of the container main body 19, and a distance W2 from the rotation shaft 23*a* of the agitation member 23 to the conveyance regulating surface 18*g* is set to be shorter than the distance W0 from the rotation shaft 23*a* to the leading end of the agitation sheet 23*b*. In addition, distances from the wall surfaces 18*d*1 and 18*d*2 to the rotation shaft 23*a* are set to be longer than the distance W2. A distance from a part of the wall surface 18*d*1 closest to the rotation shaft 23*a* to the rotation shaft 23*a* is set to be shorter than the distance W0. A distance from a part of the wall surface 18*d*2 closest to the rotation shaft 23*a* to the rotation shaft 23*a* is set to be shorter than the distance W0.

Since the distance from the wall surface 18*d*1 to the rotation shaft 23*a* and the distance from the wall surface 18*d*2 to the rotation shaft 23*a* are longer than the distance W2, in a case where the toner is conveyed by the conveyance regulating surface 18*g* and the agitation sheet 23*b*, the toner can be conveyed without hindering a trajectory of the agitation sheet 23*b*. In addition, as described above, the distance from the part of the wall surface 18*d*1 closest to the rotation shaft 23*a* to the rotation shaft 23*a* and the distance from the part of the wall surface 18*d*2 closest to the rotation shaft 23*a* to the rotation shaft 23*a* are shorter than the distance W0. In this way, the toner on the agitation sheet 23*b* is pushed into the recessed portion 18*d* by the agitation member 23, and the recessed portion 18*d* can be filled with the toner stably.

<Description of Toner Entering and Falling off of Recessed Portion>

How the toner on the agitation member 23 enters and falls off of the recessed portion 18*d* will be described with reference to FIGS. 4A to 4E. FIG. 4A illustrates the state in which the agitation sheet 23*b* starts to push the toner surface of the toner on the bottom portion 18*f*. In this state, there is no toner in the recessed portion 18*d*. Then, the agitation sheet 23*b* rotates in the direction of the arrow F, and as the agitation sheet 23*b* lifts the toner upward as illustrated in FIG. 4B, the toner starts to enter the recessed portion 18*d*. When the agitation sheet 23*b* further rotates in the direction of the arrow F, the recessed portion 18*d* is filled with the toner, as illustrated in FIG. 4C. In this state, since the toner in the recessed portion 18*d* is pressed by the agitation sheet 23*b*, the toner remains inside the recessed portion 18*d*.

When the agitation sheet 23*b* further rotates, the agitation sheet 23*b* travels past the recessed portion 18*d*, as illustrated in FIG. 4D. When the agitation sheet 23*b* travels past the recessed portion 18*d*, the recessed portion 18*d* is opened, and the toner in the recessed portion 18*d* falls by its own weight. Then, when the leading end of the agitation sheet 23*b* travels past the release position 18*c*, as described above, the toner on the agitation sheet 23*b* jumps up toward the opening 18*c*. Then, as illustrated in FIG. 4E, the agitation sheet 23*b* collides with the opening 18*c*, and the toner is pushed into the developing chamber 18*b* by the agitation sheet 23*b*. Then, when the agitation sheet 23*b* further rotates in the direction of the arrow F, the agitation sheet 23*b* and the toner are brought into their states illustrated in FIG. 4A, again.

<Location of Recessed Portion>

As described above, the toner remains in the recessed portion 18*d* between when the agitation sheet 23*b* starts to push the toner surface and when the agitation sheet 23*b* travels past the release position 18*e*. After the agitation sheet 23*b* travels past the release position 18*e*, the toner on the agitation sheet 23*b* jumps up. Thus, the state of the toner in the container main body 19 is not stable, and it is not suitable to detect whether the toner is present in the recessed portion 18*d*. If, for example, the recessed portion 18*d* is located at the bottom portion 18*f*, the recessed portion 18*d* is open upwards. In this case, the toner in the recessed portion 18*d* cannot fall by its own weight, and the toner may always remain in the recessed portion 18*d*.

Thus, to discharge the toner in the recessed portion 18*d* from the recessed portion 18*d* after the agitation sheet 23*b* travels past the recessed portion 18*d*, the recessed portion 18*d* needs to be formed above the bottom portion 18*f*. In addition, the inner walls of the recessed portion 18*d* need to be formed at such an angle that the toner in the recessed portion 18*d* is discharged by its own weight. Then, it is desirable that the recessed portion 18*d* be formed upstream of the release position 18*e* and downstream of the bottom portion 18*f* in the rotation direction of the agitation member 23 (direction of the arrow F) and be formed at a position as high as possible on the inner surface 19A of the container main body 19.

<Location of Electrodes>

The first and second electrodes 31 and 32 are arranged in the recessed portion 18*d* in a direction substantially parallel to the rotational axis direction of the developing roller 17. A gap is formed between the first and second electrodes 31 and 32. As illustrated in FIG. 5, the first and second electrodes 31 and 32 extend up to ends of the container main body 19 in the rotational axis direction of the developing roller 17. Generally, the larger an area of an electrode is, the larger the electrostatic capacitance becomes. Thus, since the areas of the first and second electrodes 31 and 32 are increased by extending the lengths of the first and second electrodes 31 and 32, it is possible to increase a change of the electrostatic capacitance that occurs when the toner passes an area between the first and second electrodes 31 and 32. By increasing the change of the electrostatic capacitance, the toner remaining amount can be detected more accurately in a toner remaining amount detection method described below.

As illustrated in FIG. 5, a memory 30, a first contact 33, and a second contact 34 are arranged on a side surface of the corresponding container main body 19 downstream in the direction in which an individual process cartridge 7 is mounted. In a state where the process cartridge 7 is mounted on the corresponding mounting portion 200 of the image forming apparatus 100, the first contact 33 is electrically connected to a first main-body-side contact 37 provided to an apparatus main body 100A, and the second contact 34 is electrically connected to a second main-body-side contact 38 provided to the apparatus main body 100A. The first main-body-side contact 37 is also electrically connected to a voltage generation circuit 35, and the second main-body-side contact 38 is also electrically connected to a voltage detection circuit 36. The voltage generation circuit 35 applies a voltage to the first contact 33 via the first main-body-side contact 37. As a result, a voltage based on the electrostatic capacitance between the first and second electrodes 31 and 32 is detected by the voltage detection circuit 36 via the second contact 34. The voltage generation circuit 35 and the voltage detection circuit 36 are arranged on the apparatus main body 100A of the image forming apparatus 100. While the first and second electrodes 31 and 32 are arranged on the inner surface 19A of the container main body 19 as illustrated in FIG. 3, the first and second electrodes 31 and 32 may be arranged on an outer wall surface of the container main body 19 as illustrated in FIG. 6.

The memory 30 is a non-volatile storage medium (storage unit) such as an electrically erasable programmable read-only memory (EEPROM). In a state where the process cartridge 7 is mounted on the corresponding mounting portion 200 of the image forming apparatus 100, a writing unit 39 of the image forming apparatus 100 can record (write) information about the number of prints and an out-of-toner state in the memory 30. Likewise, in a state where the process cartridge 7 is mounted on the corresponding mounting portion 200 of the image forming apparatus 100, a reading unit 40 of the image forming apparatus 100 can read the above information stored in the memory 30. The out-of-toner state is a state in which the amount of the toner stored in the container main body 19 is less than a predetermined amount.

<Detection of Toner Remaining Amount>

Since a permittivity of toner is higher than that of the air, when the toner enters the area between the first and second electrodes 31 and 32, the electrostatic capacitance between the first and second electrodes 31 and 32 increases. Thus, when the toner conveyed by the agitation member 23 travels the area between the first and second electrodes 31 and 32, the electrostatic capacitance between the first and second electrodes 31 and 32 increases. Then, when the agitation member 23 travels past the recessed portion 18*d* and the toner present between the first and second electrodes 31 and 32 falls by its own weight, the electrostatic capacitance between the first and second electrodes 31 and 32 decreases. In addition, when the electrostatic capacitance between the first and second electrodes 31 and 32 increases, an output voltage decreases. When the electrostatic capacitance between the first and second electrodes 31 and 32 decreases, the output voltage increases.

The time needed for the toner to travel past the area between the first and second electrodes 31 and 32 changes depending on the toner remaining amount in the container main body 19. FIG. 7 illustrates transition of the output voltage detected by the voltage detection circuit 36 while the agitation member 23 is rotating in a case where the toner remaining amount in the container main body 19 is, for example, 200 grams. FIG. 8 illustrates transition of the output voltage detected by the voltage detection circuit 36 while the agitation member 23 is rotating in a case where the toner remaining amount in the container main body 19 is, for example, 70 grams.

Figure 9A:
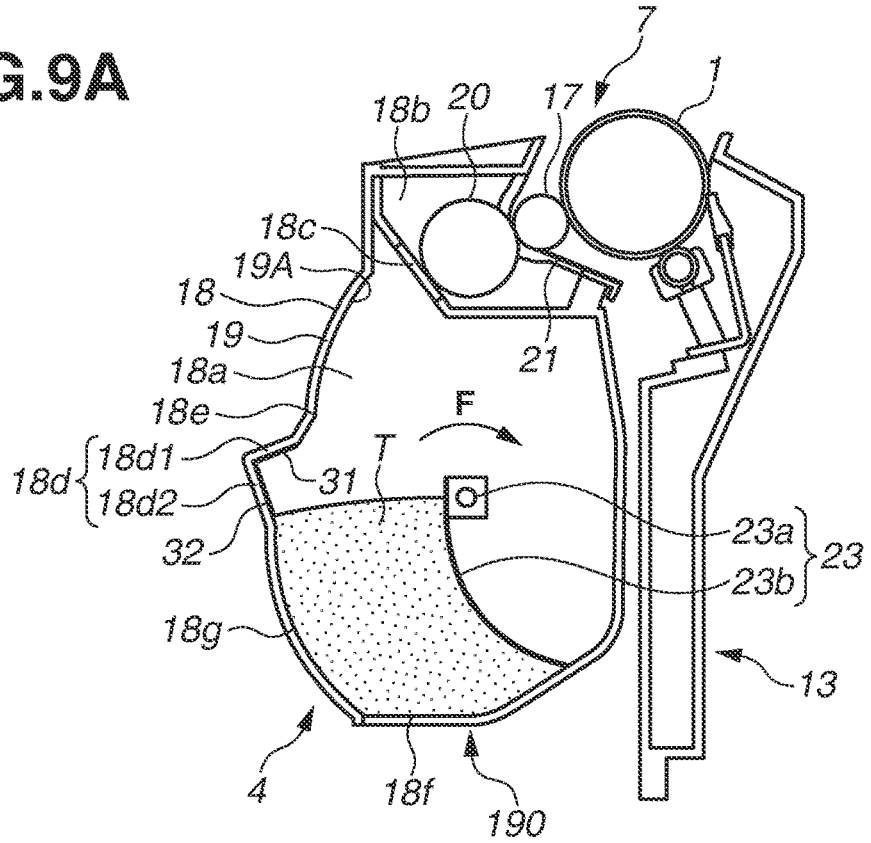
FIGS. 9A and 9B are diagrams illustrating developer being agitated.
Figure 9B:
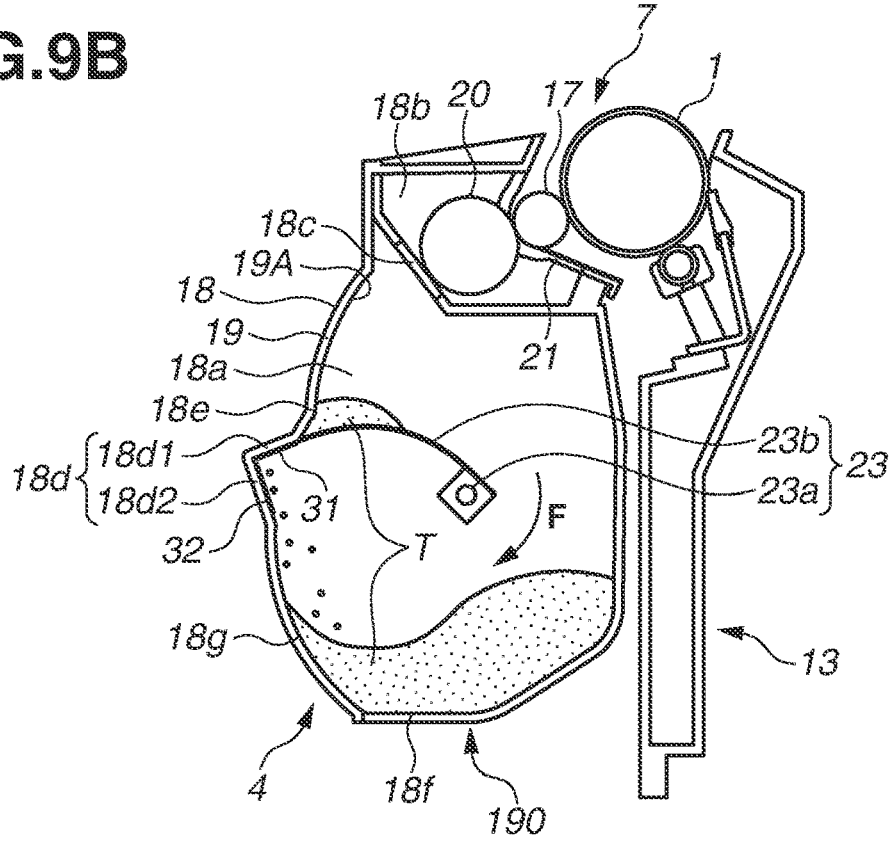

FIGS. 9A and 9B are cross-section diagrams schematically illustrating the process cartridge 7 corresponding to FIG. 7. FIG. 9A illustrates a state in which the agitation sheet 23*b* pushes the toner surface and the toner starts to enter the area between the first and second electrodes 31 and 32. This state corresponds to time t1*a* in FIG. 7. At the time t1*a*, the output voltage based on the electrostatic capacitance starts to decrease. FIG. 9B illustrates a state of the process cartridge 7 immediately after the agitation sheet 23*b* travels past the recessed portion 18*d*. When the agitation sheet 23*b* travels past the recessed portion 18*d*, the toner that has entered the recessed portion 18*d* falls by its own weight, and the toner is discharged from the area between the first and second electrodes 31 and 32. This state corresponds to time t1*b* in FIG. 7. At the time t1*b*, the output voltage based on the electrostatic capacitance starts to increase.

Figure 10A:
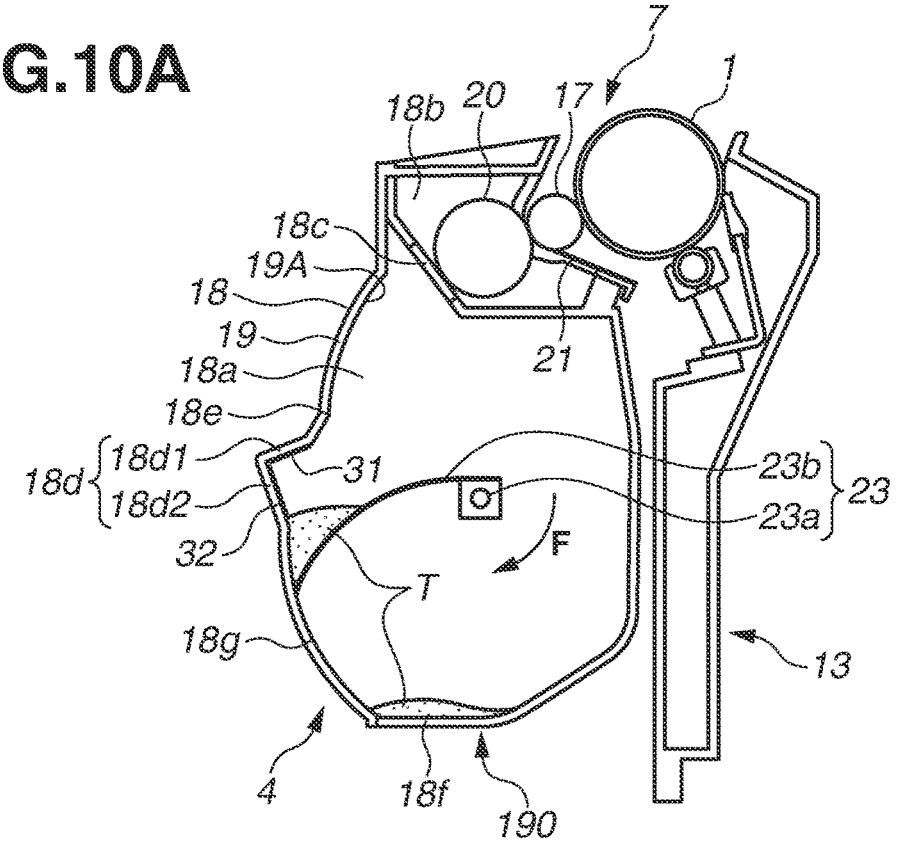
FIGS. 10A and 10B are diagrams illustrating developer being agitated.
Figure 10B:
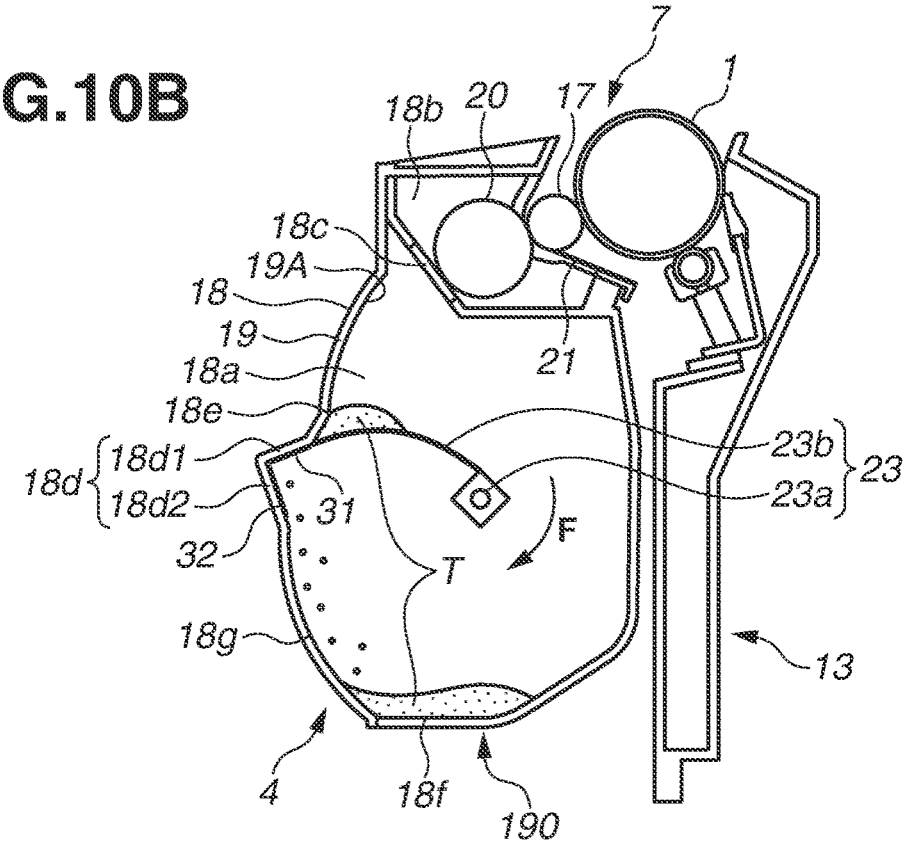

On the other hand, FIGS. 10A and 10B are cross-section diagrams schematically illustrating the process cartridge 7 corresponding to FIG. 8. FIG. 10A illustrates a state in which the toner starts to enter the area between the first and second electrodes 31 and 32. This state corresponds to time t2*a* in FIG. 8. At the time t2*a*, the output voltage based on the electrostatic capacitance starts to decrease. FIG. 10B illustrates a state of the process cartridge 7 immediately after the agitation sheet 23*b* travels past the recessed portion 18*d*. In this state, the toner is discharged from the area between the first and second electrodes 31 and 32. This state corresponds to time t2*b* in FIG. 8. At the time t2*b*, the output voltage based on the electrostatic capacitance starts to increase.

Time duration between when the output voltage starts to decrease in FIG. 7 and when the output voltage starts to increase in FIG. 7 is shorter than time duration between when the output voltage starts to decrease in FIG. 8 and when the output voltage starts to increase in FIG. 8. Thus, the image forming apparatus 100 detects the toner remaining amount in the container main body 19 based on time duration t between when the output voltage value detected by the voltage detection circuit 36 falls below a threshold and when the output voltage value exceeds the threshold.

Figure 11:
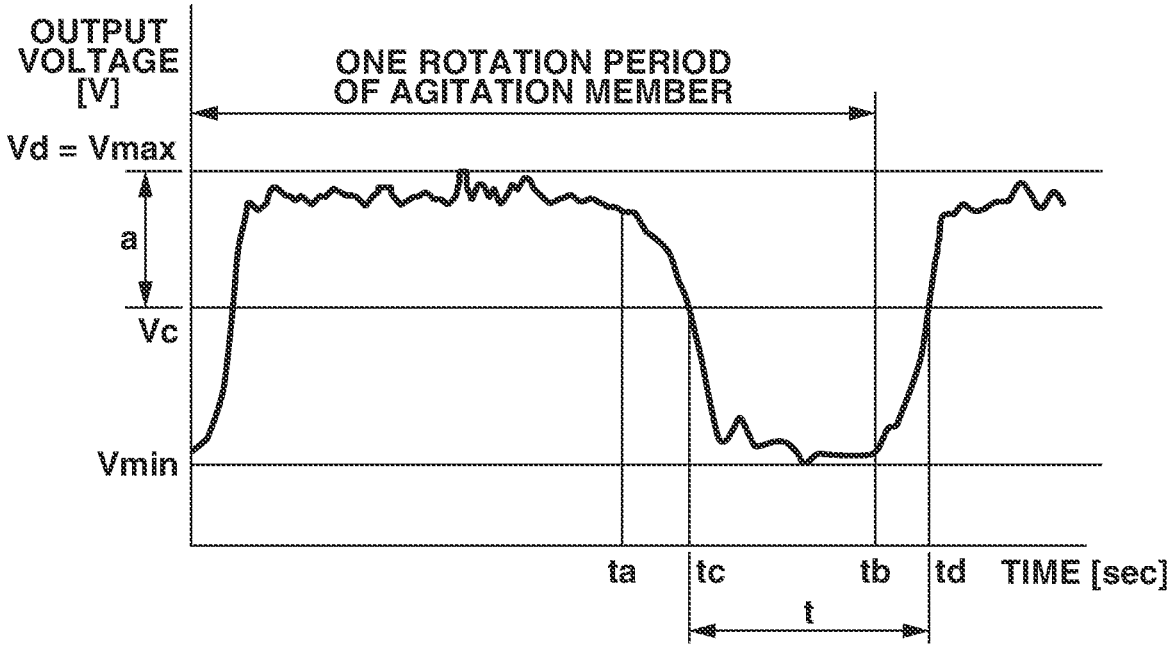
FIG. 11 is a graph schematically illustrating an output voltage obtained during an agitation operation.

A method for measuring the time duration t in which the toner travels past the recessed portion 18*d* from a waveform of an output voltage based on the electrostatic capacitance will be described below with reference to FIG. 11. FIG. 11 illustrates a waveform indicating change of the output voltage based on change of the electrostatic capacitance. As illustrated in FIG. 11, the output voltage based on the electrostatic capacitance when the toner is absent between the first and second electrodes 31 and 32 significantly differs from the output voltage based on the electrostatic capacitance when the toner is present between the first and second electrodes 31 and 32. In this case, the image forming apparatus 100 sets a reference value Vc, and detects whether the toner is present between the first and second electrodes 31 and 32 by using the reference value Vc as a reference.

In FIG. 11, after the toner enters the area between the first and second electrodes 31 and 32, the output voltage value falls below the reference value Vc at tine tc. After the toner between the first and second electrodes 31 and 32 falls by its own weight, the output voltage value exceeds the reference value Vc at time td. The time duration t (=tc−td) in which the output voltage value remains below the reference value Vc corresponds to the time in which the toner is present between the first and second electrodes 31 and 32. Then, the image forming apparatus 100 determines the toner remaining amount from the variable time duration t based on the toner remaining amount in the container main body 19.

The output voltage varies depending on variation of the electrostatic capacitance between the first and second electrodes 31 and 32. Thus, in a case where the reference value Vc is a fixed value, the time duration t cannot possibly be measured. For example, in a case where the permittivity of the toner in the container main body 19 is low, since the amount of the change of the electrostatic capacitance between the first and second electrodes 31 and 32 is small, the change of the output voltage is also small. In this case, there are cases in which the reference value Vc is above a maximum value Vmax of the output voltage (Vc>Vmax) or is below a minimum value Vmin (Vc<Vmin). In these cases, the time duration t cannot be measured stably.

In addition, when the permittivity of the toner changes with change of environmental conditions such as the temperature and the humidity under which the image forming apparatus 100 is used, the output voltage varies significantly. In this case, the output voltage value can be deviated from the reference value Vc, and consequently, the time duration t cannot possibly be measured. Thus, it is desirable that the reference value Vc be varied depending on the waveform of the output voltage. Hereinafter, a method for setting the reference value Vc will be described.

Figure 12:
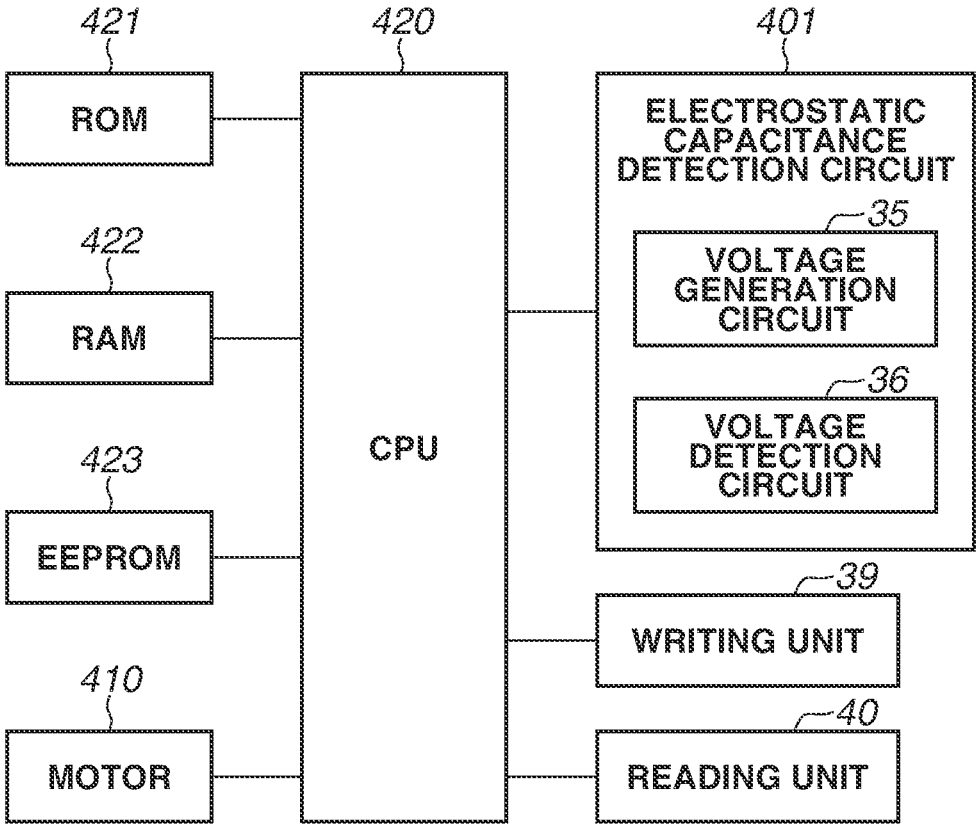
FIG. 12 is a block diagram illustrating a configuration for controlling the image forming apparatus.

FIG. 12 is a control block diagram of the image forming apparatus 100. The image forming apparatus 100 includes a central processing unit (CPU) 420, a read-only memory (ROM) 421, a random access memory (RAM) 422, and an EEPROM 423. The CPU 420 is a processor that comprehensively controls the image forming apparatus 100. The ROM 421 stores various kinds of control programs executed by the CPU 420, control data, and a conversion gable. The RAM 422 is a system work memory.

The image forming apparatus 100 further includes the voltage generation circuit 35, the voltage detection circuit 36, the writing unit 39, the reading unit 40, an electrostatic capacitance detection circuit 401, and a motor 410. Since the voltage generation circuit 35, the voltage detection circuit 36, the writing unit 39, and the reading unit 40 have already been described, a redundant description thereof will be avoided. The motor 410 is a drive source for rotating the rotation shaft 23*a* via a gear train of the apparatus main body 100A. The electrostatic capacitance detection circuit 401 is an electrical circuit including the voltage generation circuit 35 and the voltage detection circuit 36. The electrostatic capacitance detection circuit 401 is electrically connected to the first and second electrodes 31 and 32 via the first and second contacts 33 and 34. The electrostatic capacitance detection circuit 401 causes the voltage generation circuit 35 to generate a voltage at a predetermined timing and outputs a voltage detected by the voltage detection circuit 36 to the CPU 420.

When setting the reference value Vc, first, the CPU 420 measures the maximum value Vmax or the minimum value Vmin from the waveform of the output voltage detected by the voltage detection circuit 36, and sets the reference value Vc based on the maximum value Vmax or the minimum value Vmin. For example, the CPU 420 sets a value by subtracting a fixed value $\alpha$ from the maximum value Vmax of the output voltage as the reference value Vc ($Vc = Vmax - \alpha$). In this example, the fixed value a is a value determined by experiments based on, for example, variations in an arrangement relationship between the first and second electrodes 31 and 32 and variations in the properties (permittivity) of the toner used. Alternatively, the CPU 420 may set a value by adding the fixed value a to the minimum value Vmin of the output voltage as the reference value Vc ($Vc = Vmin + \alpha$).

The CPU 420 detects the toner remaining amount in the container main body 19 by determining the reference value Vc and measuring the time duration t by using the reference value Vc as a reference. Each time the CPU 420 detects the toner remaining amount in the container main body 19, the CPU 420 determines the reference value Vc. In the above example, the CPU 420 determines the toner remaining amount based on the time duration in which the output voltage is below the threshold. However, alternatively, the CPU 420 may determine the toner remaining amount based on the time duration in which the output voltage is above the threshold.

As described above, since the reference value Vc is newly set each time the CPU 420 detects the toner remaining amount in the container main body 19, the time duration t can be measured accurately, and the toner remaining amount can be detected stably. The toner remaining amount acquisition method as described above is performed at predetermined timings from when the developing unit 4 has not been used yet and the container main body 19 is sufficiently filled with the toner to when the container main body 19 is out of the toner.

In a case where the container main body 19 includes a large toner remaining amount and the toner is always present in the recessed portion 18*d*, the electrostatic capacitance between the first and second electrodes 31 and 32 does not change, and the output voltage indicates substantially the same value. Thus, even if the reference value Vc is set, the value of the time duration t indicates approximately zero. On the other hand, when the container main body 19 includes a very small or de minimis toner remaining amount, even if the agitation member 23 rotates, little toner enters the recessed portion 18*d*. In this case, the electrostatic capacitance between the first and second electrodes 31 and 32 does not change either, and the value of the time duration t indicates approximately zero. In these cases, the CPU 420 may not be able to distinguish between the state where the recessed portion 18*d* is filled with the toner and the state where the container main body 19 is out of the toner.

Thus, after the time duration t exceeds a predetermined duration, the CPU 420 determines whether the toner remaining amount in the container main body 19 is below a predetermined amount based on the number of recording media on which the image forming apparatus 100 has formed images (number of sheets on which images have been formed). For example, if the time duration t exceeds the predetermined duration and the number of sheets on which images have been formed in the state where the process cartridge 7 is mounted on the corresponding mounting portion 200 has reached, for example, 3,000, the CPU 420 determines that the toner remaining amount in the container main body 19 is less than the predetermined amount. Information about the number of sheets on which images have been formed in the state where the process cartridge 7 is mounted on the mounting portion 200 is written at a predetermined timing in the memory 30 of the process cartridge 7. The CPU 420 causes the reading unit 40 to read the information about the number of sheets on which images have been formed from the memory 30, and if the number of sheets has reached, for example, 3,000, the CPU 420 determines that the toner remaining amount in the container main body 19 is less than the predetermined amount. If the CPU 420 determines that the toner remaining amount in the container main body 19 is less than the predetermined amount, the CPU 420 causes the writing unit 39 to write information indicating the out-of-toner state in the memory 30 of the process cartridge 7. Then, the CPU 420 displays a screen requesting replacement of the process cartridge 7 on a touch panel (not illustrated).

There is a case in which the image forming apparatus 100 that detects the toner remaining amount based on the time duration t cannot accurately determine whether the process cartridge 7 mounted on the corresponding mounting portion 200 has been refilled with toner by using the time duration t. This is because the time duration t in which the recessed portion 18*d* is filled with the toner and the time duration t in which the container main body 19 is out of the toner are approximately zero. This will be described in detail with reference to the drawings.

Figure 14A:
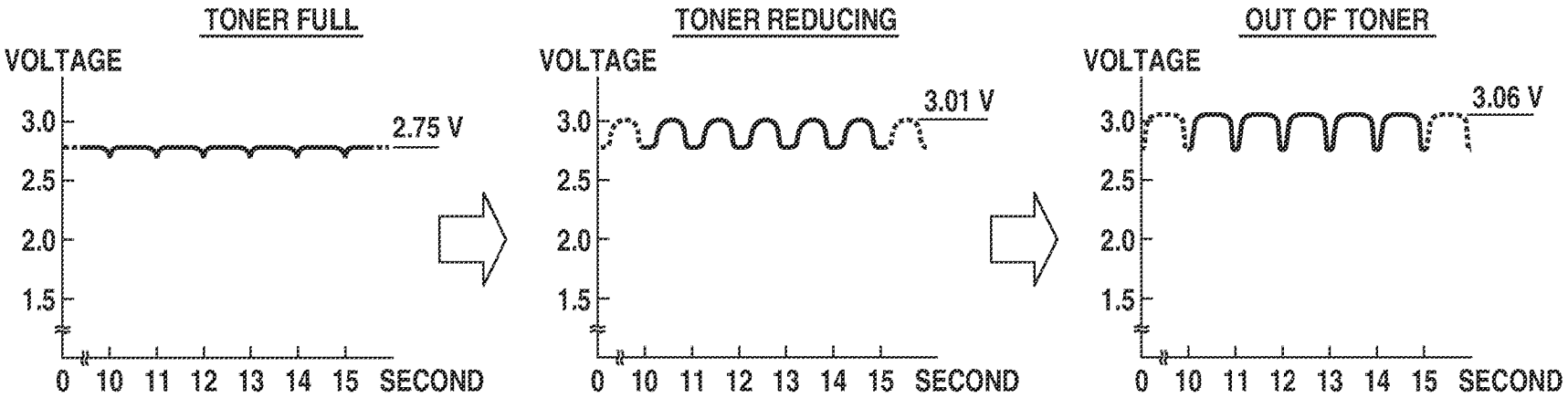
FIGS. 14A and 14B are graphs schematically illustrating output voltages during an agitation operation.
Figure 14B:
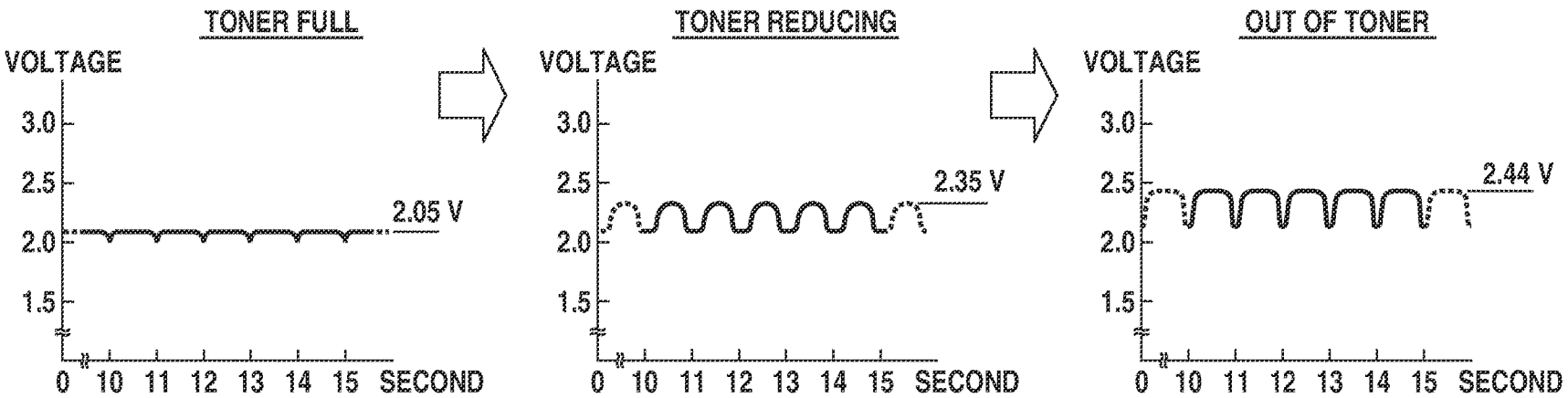

FIGS. 14A and 14B are graphs schematically illustrating output voltages that change with change of the toner remaining amounts in different cartridges CRG-A and CRG-B. FIG. 14A illustrates a waveform of an output voltage based on the toner remaining amount in the cartridge CRG-A. For example, the output voltage indicates 2.75 V in a state where the cartridge CRG-A is filled with 430 grams of toner. Subsequently, the toner remaining amount is reduced as the toner is consumed. When the cartridge CRG-A indicates the out-of-toner state, the output voltage indicates 3.06 V. FIG. 14B illustrates a waveform of an output voltage based on the toner remaining amount in the cartridge CRG-B. The output voltage indicates 2.06 V in a state where the cartridge CRG-B is filled with 430 grams of toner. Subsequently, the toner remaining amount is reduced as the toner is consumed. When the cartridge CRG-B indicates the out-of-toner state, the output voltage indicates 2.44 V.

As the toner in the cartridge is consumed and the toner remaining amount therein is consequently reduced, the output voltage increases. However, the output voltage (2.75 V) in the state where the cartridge CRG-A is sufficiently filled with the toner is higher than the maximum output voltage (2.44 V) in the state where the cartridge CRG-B indicates the out-of-toner state. Thus, in a case where the output voltage decreases in a state where information indicating the out-of-toner state is stored in the memory 30 of the process cartridge 7 and if the same cartridge is used, the CPU 420 can determine that the process cartridge 7 has been refilled with toner. However, the following issues may arise.

The first issue is that, after the cartridge CRG-B indicates the out-of-toner state, if the cartridge CRG-B is replaced by a refilled cartridge CRG-A, the CPU 420 cannot determine whether the refilled cartridge CRG-A has newly been mounted. This is because the output voltage (2.75 V) of the cartridge CRG-A is higher than the output voltage (2.44 V) of the cartridge CRG-B in the out-of-toner state. Since the output voltage has increased, the CPU 420 cannot determine whether the cartridge CRG-B is mounted or another cartridge (cartridge CRG-A) is mounted based on the output voltage.

The second issue is that, after the cartridge CRG-A indicates the out-of-toner state, if the cartridge CRG-B indicating the out-of-toner state is mounted, the CPU 420 erroneously detects that a refilled cartridge has been mounted although the cartridge CRG-B has not been refilled with toner. This is because the output voltage has decreased from the output voltage (3.06 V) of the cartridge CRG-A indicating the out-of-toner state to the output voltage (2.44 V) of the cartridge CRG-B indicating the out-of-toner state. Since the output voltage has decreased, the CPU 420 erroneously detects that the cartridge CRG-B is a refilled cartridge.

Thus, the CPU 420 determines whether the process cartridge 7 mounted on the mounting portion 200 is a refilled process cartridge based on the information indicating the out-of-toner state and a fluctuation amount of the output voltage read from the memory 30. Hereinafter, the fluctuation amount of the output voltage will be described.

Figure 13A:
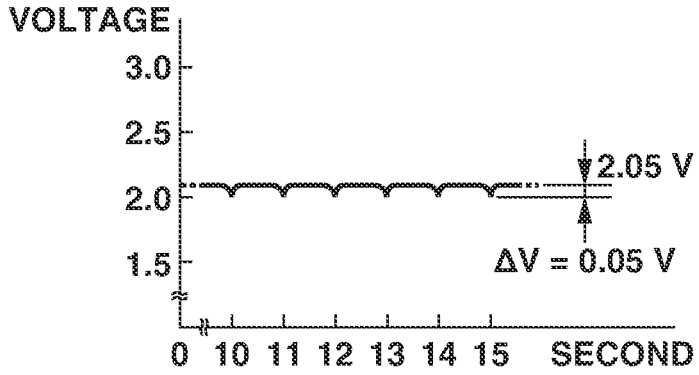
FIGS. 13A to 13C are graphs schematically illustrating output voltages during an agitation operation.
Figure 13B:
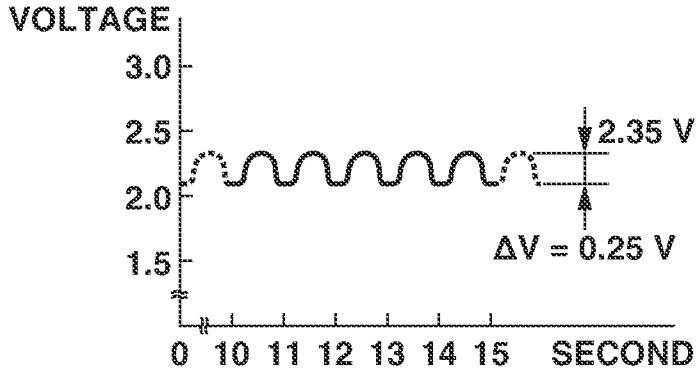
Figure 13C:
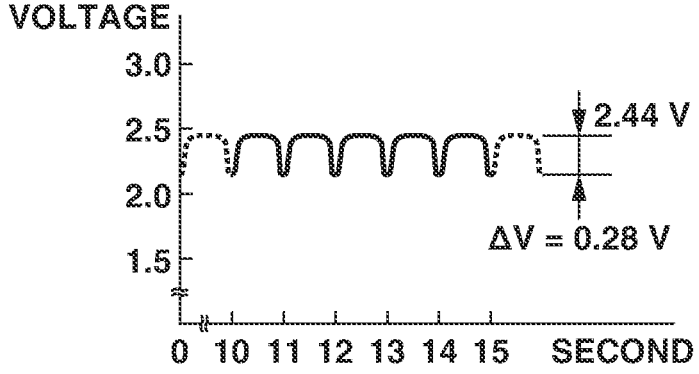

FIG. 13A schematically illustrates a waveform of an output voltage detected by the voltage detection circuit 36 in a case where the stored toner weighs, for example, 430 grams. FIG. 13B illustrates a waveform of an output voltage detected by the voltage detection circuit 36 in a case where the stored toner weighs, for example, 108 grams. FIG. 13C illustrates a waveform of an output voltage detected by the voltage detection circuit 36 in a case where the stored toner weighs, for example, 20 grams. The output voltage decreases as a density of the toner (amount of the toner) between the electrodes increases. The output voltage increases as the density of the toner (amount of the toner) decreases. In addition, as described above, since the density of the toner (amount of the toner) between the electrodes fluctuates in synchronization with the rotation of the agitation sheet 23*b*, the waveform of the output voltage fluctuates with a predetermined period.

As illustrated in FIG. 13A, when the cartridge is sufficiently filled with the toner, since the toner is always present between the electrodes, for example, a voltage of 2.05 V is detected. Since the density of the toner (amount of the toner) between the electrodes shows little fluctuation by the agitation operation, the output voltage fluctuates little. In FIG. 13A, a fluctuation amount $\Delta V$ of the voltage is 0.05 V.

The toner is consumed as images are formed, whereby the amount of the toner is reduced. Thus, as illustrated in FIG. 13B, the output voltage increases. In FIG. 13B, the maximum output voltage reaches, for example, 2.35 V. In addition, since the density of the toner (amount of the toner) between the electrodes is changed by the agitation operation, the fluctuation amount $\Delta V$ of the output voltage reaches 0.25 V.

If the amount of the toner falls below 30 g as the toner is consumed, the developing roller is not sufficiently supplied with the toner. A state in which the amount of the toner is reduced to a level at which the developing roller 17 cannot be supplied with the sufficient toner and the amount of the toner reaches a predetermined amount or less is called an "out-of-toner state". In the out-of-toner state, the time duration in which no toner is present between the electrodes is further extended. As illustrated in FIG. 13C, the maximum output voltage reaches, for example, 2.44 V. In this case, in the waveform of the output voltage, the output voltage remains at the low level for a very short or de minimis time period, and the time period becomes much shorter than a time period during which the output voltage remains at the high level.

Figure 15:
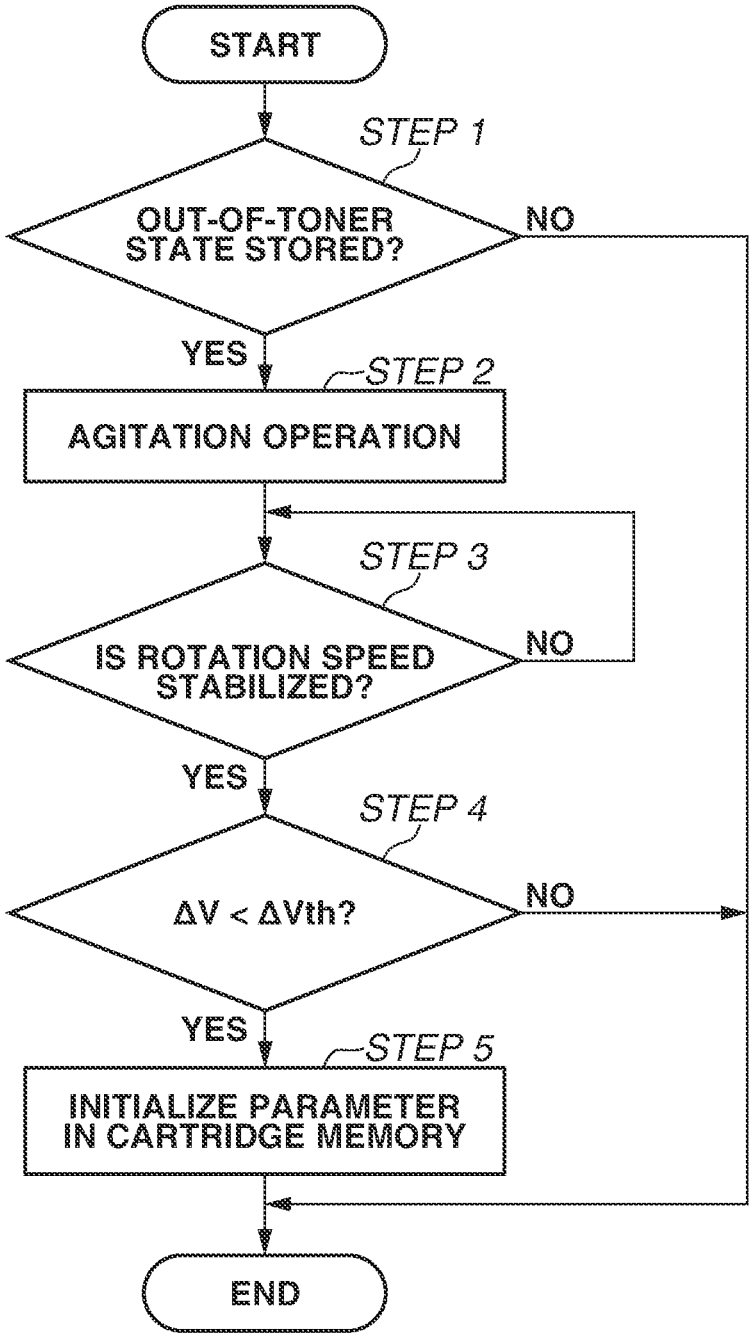
FIG. 15 is a flowchart illustrating refill detection processing.

More specifically, the fluctuation amount ΔV of the refilled process cartridge 7 is smaller than the fluctuation amount ΔV of the process cartridge 7 indicating the out-of-toner state. Thus, in a case where information indicating the out-of-toner state is stored in the memory 30 and the fluctuation amount ΔV is smaller than a threshold ΔVth, the CPU 420 determines that the process cartridge 7 mounted on the mounting portion 200 is the refilled process cartridge. Hereinafter, refill detection processing will be described with reference to the control block diagram in FIG. 12 and a flowchart in FIG. 15.

In a case where power supply of the image forming apparatus 100 is turned on or the process cartridge 7 is replaced, the CPU 420 performs the refill detection processing. In Step 1, when starting the refill detection processing, the CPU 420 causes the reading unit 40 to read the memory 30 of the process cartridge 7 mounted on the corresponding mounting portion 200, and determines whether information indicating the out-of-toner state is stored in the memory 30. If the information indicating the out-of-toner state is not stored in the memory 30 (NO in Step 1), the CPU 420 determines that the process cartridge 7 mounted on the mounting portion 200 is not a refilled process cartridge, and ends the refill detection processing.

If the CPU 420 determines that the information indicating the out-of-toner state is stored in the memory 30 (YES in Step 1), in Step 2, the CPU 420 controls the motor 410 to drive the agitation member 23. Then, in Step 3, the CPU 420 waits for a predetermined time until the rotation speed of the agitation member 23 stabilizes. Subsequently, in Step 4, the CPU 420 controls the electrostatic capacitance detection circuit 401 to measure the output voltage, and determines whether the fluctuation amount (ΔV) of the output voltage is below the threshold ΔVth. In Step 4, the CPU 420 determines whether the fluctuation amount ΔV of the output voltage outputted from the electrostatic capacitance detection circuit 401 while the agitation member 23 is rotating is below the threshold ΔVth. For example, the threshold ΔVth is 0.15 V. However, the value of the threshold ΔVth is not limited thereto. The threshold ΔVth is determined in advance by experiments and stored in the ROM 421. If the fluctuation amount ΔV is the threshold ΔVth or more (NO in Step 4), the CPU 420 determines that the process cartridge 7 mounted on the mounting portion 200 is not a refilled process cartridge, and ends the refill detection processing.

On the other hand, in Step 4, if the fluctuation amount ΔV is less than the threshold ΔVth (YES in Step 4), in Step 5, the CPU 420 initializes the information about the number of sheets on which images have been formed that is stored by the writing unit 39 in the memory 30 of the process cartridge 7. The initial value of the number of sheets is 0. Then, the CPU 420 ends the refill detection processing.

As described in the present embodiment, when information indicating the out-of-toner state is stored in the memory 30 of the process cartridge 7, the CPU 420 measures an amplitude of the output voltage (i.e., fluctuation amount ΔV), and determines whether the cartridge has been refilled by comparing the amplitude (ΔV) with the threshold Vth. In this way, even with a configuration in which accuracy in the detection of the toner remaining amount is insufficient, whether the cartridge has been refilled with the toner can be detected accurately.

More specifically, the image forming apparatus 100 according to the present embodiment can accurately determine whether an individual process cartridge 7 mounted on the corresponding mounting portion 200 is a refilled process cartridge.

In the image forming apparatus 100 according to the first embodiment, the process cartridge 7 including the photosensitive unit 13 and the developing unit 4 can be attached to the corresponding mounting portion 200 and detached therefrom. However, alternatively, the photosensitive unit 13 and the developing unit 4 may be configured to be individually attachable to the corresponding mounting portion 200 and detachable therefrom. In the case of the image forming apparatus 100 with this configuration, the corresponding developing unit 4 is replaced when the out-of-toner state occurs. More specifically, the developing unit 4 serves as a container containing the toner. This configuration is more economical than the configuration using the process cartridge 7 including the photosensitive unit 13 and the developing unit 4. In addition, since an amount of waste can be reduced, this configuration is more environmentally friendly.

More specifically, the image forming apparatus 100 according to the present embodiment can accurately determine whether the developing unit 4 mounted on the corresponding mounting portion 200 is a refilled developing unit.

A second embodiment will be described with reference to FIG. 16. Components of the image forming apparatus according to the second embodiment that have the same functions as those of the image forming apparatus 100 according to the first embodiment will be denoted by the same reference characters, and redundant descriptions thereof will be avoided. An individual process cartridge according to the second embodiment has a different configuration from that of the individual process cartridge according to the first embodiment. In the case of an individual process cartridge 60 according to the second embodiment, a corresponding toner cartridge 90 can be attached to a corresponding developing unit 80 and detached therefrom. In addition, the image forming apparatus according to the second embodiment can accurately acquire an amount of toner in the individual toner cartridge 90. The toner cartridge 90 serves as a container that contains the toner.

The image forming apparatus 100 transfers a rotation driving force to the process cartridges 60 and the toner cartridges 90. In addition, the image forming apparatus 100 applies biases (a charging bias, a developing bias, etc.) to the process cartridges 60. In addition, the process cartridges 60 and the toner cartridges 90 are independently attachable to the image forming apparatus 100 and detachable therefrom.

Figure 16:
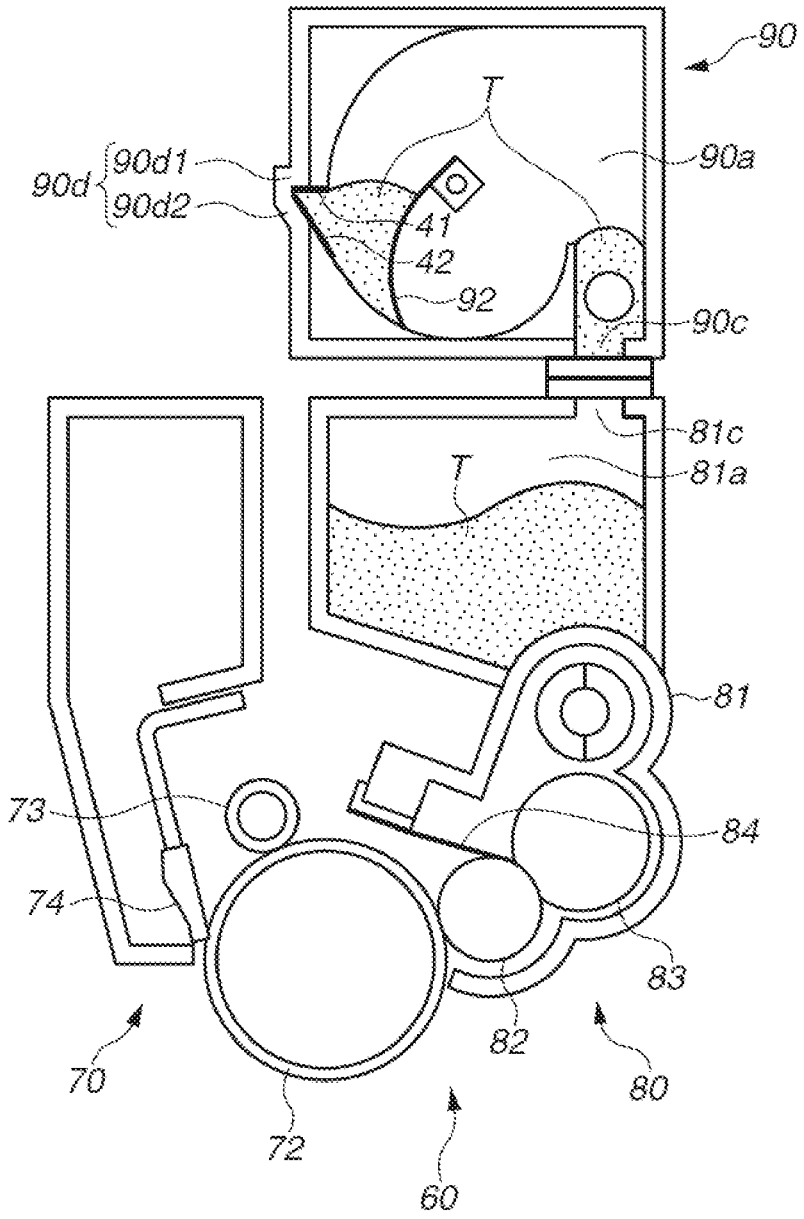
FIG. 16 is a cross-section diagram schematically illustrating a developer container and a process cartridge according to another embodiment.

As illustrated in FIG. 16, an individual process cartridge 60 includes a cleaning unit 70 and the developing unit 80. The cleaning unit 70 includes a photosensitive drum 72, a charging roller 73, and a cleaning blade 74. Since the configuration of the cleaning unit 70 is the same as that of the photosensitive unit 13 according to the first embodiment, a detailed description of the cleaning unit 70 will be avoided. In addition, the developing unit 80 includes a developing roller 82, a toner supplying roller 83, a developer regulating member 84, and a developing frame member 81 that supports various parts in the developing unit 80. Since the configuration of the developing unit 80 is the same as that of the developing unit 4 in the first embodiment, a detailed description of the developing unit 80 will be avoided. The developing frame member 81 is provided with a toner container 81*a* that contains the toner T.

The toner cartridge 90 includes a supply toner container 90*a* that contains the toner T. The supply toner container 90*a* includes a supply opening 90*c* for supplying the toner to the process cartridge 60. In addition, the toner container 81*a* of the process cartridge 60 includes a receiving opening 81*c*, and the inside of the supply toner container 90*a* and the inside of the toner container 81*a* communicate with each other via the supply opening 90*c* and the receiving opening 81*c*. By the process cartridge 60 and the toner cartridge 90 being mounted on the image forming apparatus 100, the supply opening 90*c* and the receiving opening 81*c* communicate with each other, and the toner is supplied from the cartridge 90 to the developing unit 80.

A configuration for detecting the toner remaining amount in the supply toner container 90*a* of the toner cartridge 90 will be described. As illustrated in FIG. 16, a supply toner agitation member 92 that agitates the toner and conveys the toner to the supply opening 90*c* is arranged in the supply toner container 90*a*. In addition, a recessed portion 90*d* is formed in the supply toner container 90*a*, and a first electrode 41 and a second electrode 42 are formed on a wall surface 90*d*1 and a wall surface 90*d*2, respectively, that form the recessed portion 90*d*. As the supply toner agitation member 92 rotates, the toner enters the recessed portion 90*d*, and electrostatic capacitance between the first and second electrodes 41 and 42 changes. The configuration of the supply toner agitation member 92 is the same as that of the agitation member 23 according to the first embodiment, and the configuration of the recessed portion 90*d* is the same as that of the recessed portion 18*d* according to the first embodiment. Thus, detailed descriptions of these components will be avoided. The image forming apparatus according to the second embodiment acquires the amount of the toner in the supply toner container 90*a* in the same way as the image forming apparatus according to the first embodiment.

As described above, the image forming apparatus according to the second embodiment can accurately determine whether the individual toner cartridge 90 has been refilled. In addition, in the case of the image forming apparatus according to the second embodiment, the individual supply toner container 90*a* is attachable to the corresponding developing unit 80 and detachable therefrom. Thus, by replacing the supply toner container 90*a*, toner can be supplied to the corresponding developing unit 80.

Figure 17:
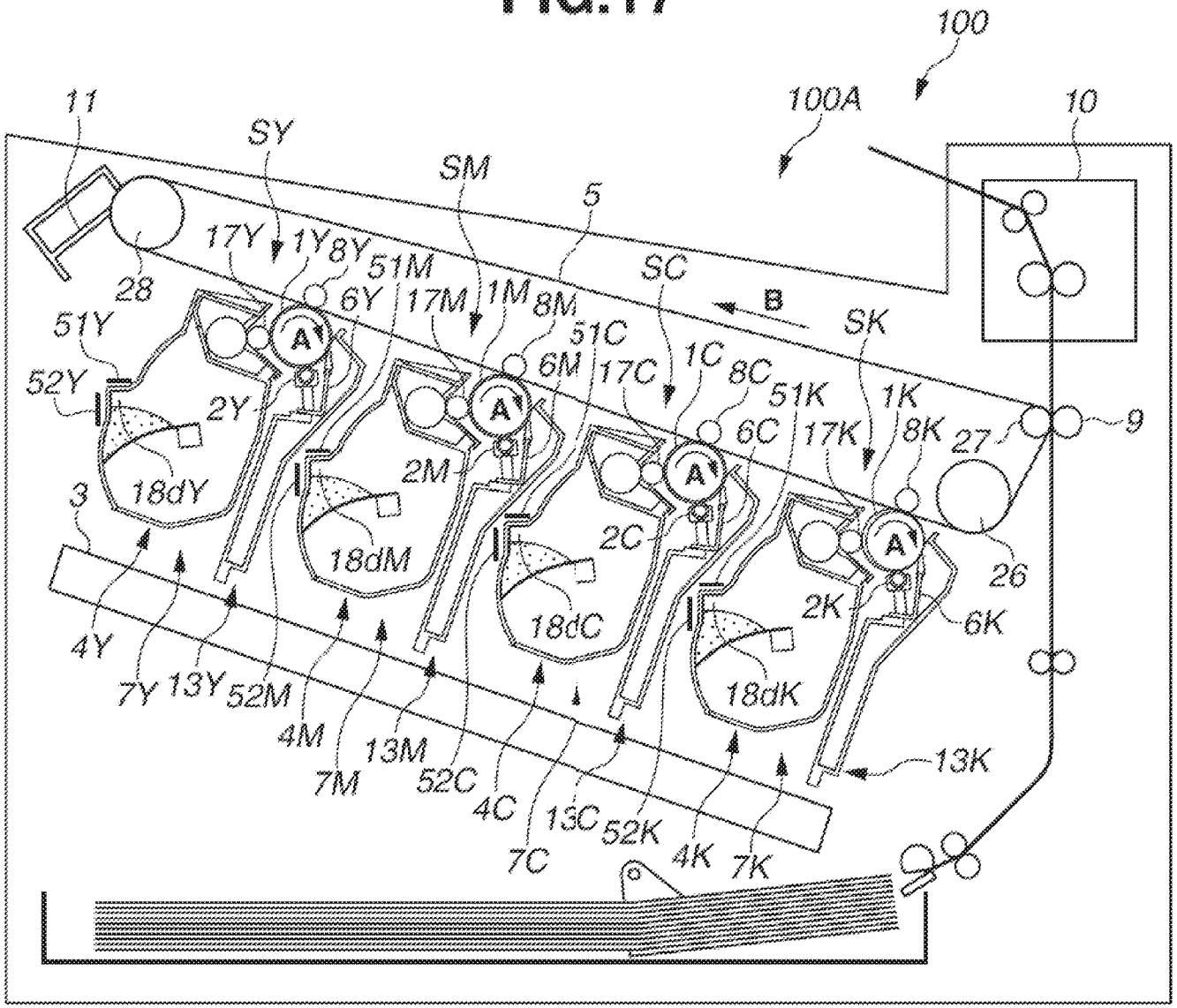
FIG. 17 is a cross-section diagram schematically illustrating an image forming apparatus according to another embodiment.

A third embodiment will be described. Components of an image forming apparatus 100 according to the third embodiment that have the same functions as those of the image forming apparatus 100 according to the first embodiment will be denoted by the same reference characters, and redundant descriptions thereof will be avoided. In the image forming apparatus 100 according to the third embodiment, first electrodes 51 and second electrodes 52 are arranged on the image forming apparatus 100. The configurations of the image forming apparatus 100 and the process cartridges 7 according to the third embodiment are similar to those of the image forming apparatus 100 and the process cartridges 7 according to the first embodiment. In the image forming apparatus 100 according to the third embodiment, the first and second electrodes 51 and 52 are arranged on the image forming apparatus 100, as illustrated in FIG. 17.

In the image forming apparatus 100 according to the third embodiment, as in the image forming apparatus 100 according to the first embodiment, the process cartridges 7 are attachable to the image forming apparatus 100 and detachable therefrom. The first electrodes 51 (51Y to 51K) and the second electrodes 52 (52Y to 52K) are arranged on the apparatus main body 100A of the image forming apparatus 100, not on the respective container main bodies 19. The individual first electrode 51 and the individual second electrode 52 are arranged on the image forming apparatus 100 in such a manner that the electrodes 51 and 52 sandwich a space in the corresponding recessed portion 18*d*. In this way, as in the first embodiment, whether the toner is present in the recessed portion 18*d* (18*d*Y to 18*d*K) is detected by using the voltage based on the electrostatic capacitance between the corresponding first and second electrodes 51 and 52, and the amount of the toner in the corresponding container main body 19 is acquired.

As described above, as in the image forming apparatus 100 according to the first embodiment, the image forming apparatus 100 according to the third embodiment can accurately determine whether the individual developing unit 80 has been refilled with toner. As described above, in the image forming apparatus 100 according to the third embodiment, the first electrodes 51 and the second electrodes 52 are arranged on the apparatus main body 100A body of the image forming apparatus 100, not on the respective process cartridges 7. Thus, even when the process cartridge 7 is replaced, the corresponding first and second electrodes can be used without replacement. The image forming apparatus 100 according to the third embodiment has a fewer number of components of the individual process cartridge and refined recycling efficiency.

In each of the embodiments, the threshold is calculated by subtracting or adding a fixed value from or to the reference value. However, the fixed value is not necessarily a constant value. For example, the fixed value may be a value that changes depending on the number of rotations of the corresponding developing roller.

In each of the embodiments, the threshold is calculated by subtracting or adding a fixed value from or to the reference value. However, the threshold may also be calculated without using the fixed value. For example, the threshold may be obtained from a table about a correspondence relationship between an individual reference value and an individual threshold.

In addition, in each of the embodiments, a threshold is changed by using the maximum value or the minimum value of the voltage as the reference value. However, the threshold may be calculated in another way. For example, the CPU 420 may calculate the threshold from an average value of voltages in a time duration in which acquisition of the developer remaining amount is performed.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2018-014815, filed Jan. 31, 2018, which is hereby incorporated by reference herein in its entirety.

What is claimed is:

1. An image forming apparatus to form an image by using toner, the image forming apparatus comprising:

a mounting portion on which a container containing the toner is configured to be mounted;

a motor configured to rotate an agitation member in the container mounted on the mounting portion;

an electrical circuit configured to acquire an output value corresponding to electrostatic capacitance between a plurality of electrodes of the container mounted on the mounting portion; and a controller configured to:

control the motor to rotate the agitation member of the container mounted on the mounting portion, control the electrical circuit to acquire the output value, detect an amount of toner in the container mounted on the mounting portion based on the output value acquired by the electrical circuit, and write predetermined information in a memory of the container mounted on the mounting portion in a case where the detected amount is below a predetermined amount, wherein, in a case where the predetermined information is stored in the memory of the container currently mounted on the mounting portion, the controller determines whether the container currently mounted on the mounting portion is a refilled container based on the output value acquired by the electrical circuit while the agitation member is rotating.

2. The image forming apparatus according to claim 1, wherein, in a case where the predetermined information is stored in the memory of the container currently mounted on the mounting portion, the controller determines whether the container currently mounted on the mounting portion is a refilled container based on a fluctuation amount of the output value acquired by the electrical circuit while the agitation member is rotating.

3. The image forming apparatus according to claim 2, wherein the amount of toner between the plurality of electrodes of the container mounted on the mounting portion changes as the agitation member of the container mounted on the mounting portion rotates, wherein the output value acquired by the electrical circuit decreases as the amount of toner between the plurality of electrodes of the container mounted on the mounting portion increases, and wherein the output value acquired by the electrical circuit increases as the amount of toner between the plurality of electrodes of the container mounted on the mounting portion decreases.

4. The image forming apparatus according to claim 1, wherein, in a case where a fluctuation amount of the output value acquired by the electrical circuit while the agitation member is rotating is less than a threshold amount, the controller determines that the container currently mounted on the mounting portion is a refilled container.

5. The image forming apparatus according to claim 1, wherein the controller controls the electrical circuit to acquire the output value by using the electrical circuit while the agitation member is rotating, and determines whether the amount of toner in the container mounted on the mounting portion is less than the predetermined amount based on a time duration in which the acquired output value is less than a reference value.

6. The image forming apparatus according to claim 5, wherein the controller determines whether the amount of toner in the container mounted on the mounting portion is less than the predetermined amount by determining the reference value based on another output value acquired by the electrical circuit while the agitation member of the container mounted on the mounting portion is not rotating.

7. The image forming apparatus according to claim 1, wherein, in a case where the container currently mounted on the mounting portion is a refilled container, the controller writes other information in the memory of the container currently mounted on the mounting portion.

8. The image forming apparatus according to claim 7, wherein the other information includes information about a number of recording media on which images have been formed by using the container currently mounted on the mounting portion.

9. A method for an image forming apparatus to form an image by using toner, wherein the image forming apparatus includes a mounting portion on which a container containing the toner is configured to be mounted, a motor configured to rotate an agitation member in the container mounted on the mounting portion, and an electrical circuit configured to acquire an output value corresponding to electrostatic capacitance between a plurality of electrodes of the container mounted on the mounting portion, the method comprising:

controlling the motor to rotate the agitation member of the container mounted on the mounting portion;

controlling the electrical circuit to acquire the output value;

detecting an amount of toner in the container mounted on the mounting portion based on the output value acquired by the electrical circuit; and writing predetermined information in a memory of the container mounted on the mounting portion in a case where the detected amount is below a predetermined amount, wherein, in a case where the predetermined information is stored in the memory of the container currently mounted on the mounting portion, controlling includes determining whether the container currently mounted on the mounting portion is a refilled container based on the output value acquired by the electrical circuit while the agitation member is rotating.

10. The method according to claim 9, wherein, in a case where the predetermined information is stored in the memory of the container currently mounted on the mounting portion, controlling includes determining whether the container currently mounted on the mounting portion is a refilled container based on a fluctuation amount of the output value acquired by the electrical circuit while the agitation member is rotating.

11. The method according to claim 10, wherein the amount of toner between the plurality of electrodes of the container mounted on the mounting portion changes as the agitation member of the container mounted on the mounting portion rotates, wherein the output value acquired by the electrical circuit decreases as the amount of toner between the plurality of electrodes of the container mounted on the mounting portion increases, and wherein the output value acquired by the electrical circuit increases as the amount of toner between the plurality of electrodes of the container mounted on the mounting portion decreases.

12. The method according to claim 9, wherein, in a case where a fluctuation amount of the output value acquired by the electrical circuit while the agitation member is rotating is less than a threshold amount, controlling includes determining that the container currently mounted on the mounting portion is a refilled container.

13. The method according to claim 9, wherein controlling includes controlling the electrical circuit to acquire the output value by using the electrical circuit while the agitation member is rotating, and determining whether the amount of toner in the container mounted on the mounting portion is less than the predetermined amount based on a time duration in which the acquired output value is less than a reference value.

14. The method according to claim 13, wherein determining whether the amount of toner in the container mounted on the mounting portion is less than the predetermined amount is by determining the reference value based on another output value acquired by the electrical circuit while the agitation member of the container mounted on the mounting portion is not rotating.

15. The method according to claim 9, wherein, in a case where the container currently mounted on the mounting portion is a refilled container, controlling includes writing other information in the memory of the container currently mounted on the mounting portion.

16. The method according to claim 15, wherein the other information includes information about a number of recording media on which images have been formed by using the container currently mounted on the mounting portion.

17. A non-transitory computer-readable storage medium storing a program to cause a computer to perform a method for an image forming apparatus to form an image by using toner, wherein the image forming apparatus includes a mounting portion on which a container containing the toner is configured to be mounted, a motor configured to rotate an agitation member in the container mounted on the mounting portion, and an electrical circuit configured to acquire an output value corresponding to electrostatic capacitance between a plurality of electrodes of the container mounted on the mounting portion, the method comprising:

controlling the motor to rotate the agitation member of the container mounted on the mounting portion;

controlling the electrical circuit to acquire the output value;

detecting an amount of toner in the container mounted on the mounting portion based on the output value acquired by the electrical circuit; and writing predetermined information in a memory of the container mounted on the mounting portion in a case where the detected amount is below a predetermined amount, wherein, in a case where the predetermined information is stored in the memory of the container currently mounted on the mounting portion, controlling includes determining whether the container currently mounted on the mounting portion is a refilled container based on the output value acquired by the electrical circuit while the agitation member is rotating.

* * * * *